US008434285B2

(12) United States Patent
Harrison

(10) Patent No.: US 8,434,285 B2
(45) Date of Patent: May 7, 2013

(54) TILED TRANSITION BRACKETING

(76) Inventor: Steven L. Harrison, Eagan, MN (US)

( * ) Notice: Subject to any disclaimer, the term of this patent is extended or adjusted under 35 U.S.C. 154(b) by 0 days.

(21) Appl. No.: 13/465,753

(22) Filed: May 7, 2012

(65) Prior Publication Data

US 2012/0216482 A1 Aug. 30, 2012

Related U.S. Application Data

(63) Continuation of application No. 12/752,315, filed on Apr. 1, 2010, now Pat. No. 8,171,685, which is a continuation of application No. 11/799,537, filed on May 2, 2007, now abandoned, which is a continuation-in-part of application No. 11/655,541, filed on Jan. 19, 2007, now Pat. No. 7,712,271.

(51) Int. Cl.
*E04G 21/14* (2006.01)
*E04B 1/38* (2006.01)

(52) U.S. Cl.
USPC ..... 52/747.11; 52/287.1; 52/391; 52/716.1

(58) Field of Classification Search ..... 52/254–257, 52/287.1, 288.1, 717.03, 717.05, 386, 387, 52/389, 390, 391, 747.11
See application file for complete search history.

(56) References Cited

U.S. PATENT DOCUMENTS

| | | | | |
|---|---|---|---|---|
| 1,030,044 | A | | 6/1912 | Wittbecke |
| 1,917,139 | A | | 7/1933 | McCutcheon |
| 2,069,289 | A | | 2/1937 | Swendsen et al. |
| 2,114,044 | A | | 4/1938 | Bonnell |
| 2,151,605 | A | | 3/1939 | Layering |
| 2,207,178 | A | | 7/1940 | Richards |
| 2,697,019 | A | | 12/1954 | Stefan |
| 2,994,905 | A | | 8/1961 | Franker, Jr. |
| 3,092,869 | A | | 6/1963 | Stump |
| 3,228,165 | A | | 1/1966 | Begian |
| 3,310,921 | A | | 3/1967 | Forcadell |
| 3,411,257 | A | | 11/1968 | Yaremchuk |
| 3,817,012 | A | * | 6/1974 | Wack et al. ..... 52/315 |
| 4,014,618 | A | | 3/1977 | Kristiansen |
| 4,091,586 | A | | 5/1978 | Schwartz |

(Continued)

FOREIGN PATENT DOCUMENTS

| | | |
|---|---|---|
| EP | 0449733 A1 | 2/1991 |
| EP | 0501642 A1 | 2/1992 |

(Continued)

OTHER PUBLICATIONS

International Search Report and Written Opinion from related PCT Application PCT/US2008/005382, dated Nov. 5, 2008 (21 pgs).

(Continued)

*Primary Examiner* — Christine T Cajilig
(74) *Attorney, Agent, or Firm* — Brooks, Cameron & Huebsch, PLLC

(57) ABSTRACT

The present disclosure includes various brackets and systems for forming tiled transitions between surfaces. One bracket embodiment for forming a tiled transition between a first surface and a second surface forming an inside corner includes a first base portion securable to the first surface, a second base portion securable to the second surface, a receiving slot angled with respect to the first and second surfaces for receiving a tile strip to form the tiled transition, and a channel for receiving a filler material adjacent to the receiving slot.

16 Claims, 12 Drawing Sheets

U.S. PATENT DOCUMENTS

| | | | |
|---|---|---|---|
| 4,601,149 | A | 7/1986 | Dokan |
| 4,651,488 | A | 3/1987 | Nicholas et al. |
| 4,769,199 | A | 9/1988 | Bemis et al. |
| 5,181,357 | A | 1/1993 | Pourtau et al. |
| 5,199,237 | A | 4/1993 | Juntunen |
| 5,203,640 | A | 4/1993 | Pourtau et al. |
| 5,243,799 | A | 9/1993 | Schluter |
| 5,256,105 | A | 10/1993 | Austin |
| 5,289,663 | A | 3/1994 | Schluter |
| 5,404,684 | A | 4/1995 | Schwendeman |
| 5,477,643 | A | 12/1995 | Koenig, Jr. |
| 5,544,463 | A | 8/1996 | Bergin |
| 5,655,345 | A | 8/1997 | Thompson |
| 5,877,451 | A | 3/1999 | Zimmerman |
| 6,055,789 | A | 5/2000 | Zimmerman |
| 6,282,855 | B1 | 9/2001 | Shipton |
| 6,309,036 | B1 | 10/2001 | Ancel |
| 6,329,599 | B1 | 12/2001 | Zimmerman |
| 6,401,418 | B1 | 6/2002 | Senn et al. |
| 6,516,576 | B1 | 2/2003 | Balmer |
| 6,591,575 | B2 | 7/2003 | Benedettini |
| 6,755,000 | B2 | 6/2004 | Wone Hahn |
| 7,408,113 | B2 | 8/2008 | Caveney et al. |
| 7,712,271 | B2 | 5/2010 | Harrison |
| 8,171,685 | B2 | 5/2012 | Harrison |
| 2002/0014046 | A1 | 2/2002 | Korn |
| 2002/0194802 | A1 | 12/2002 | Cousin |
| 2005/0011159 | A1 | 1/2005 | Standal et al. |
| 2007/0125021 | A1 | 6/2007 | Thiers et al. |
| 2008/0134602 | A1 | 6/2008 | Schick |
| 2009/0139168 | A1 | 6/2009 | Grissom et al. |

FOREIGN PATENT DOCUMENTS

| | | | |
|---|---|---|---|
| GB | 2412383 | | 9/2005 |
| WO | 98/49413 | A1 | 11/1998 |
| WO | 20081088886 | A1 | 7/2008 |

OTHER PUBLICATIONS

International Search Report and Written Opinion from related PCT Application PCT/US2008/000703, dated Jan. 18, 2008 (19 pgs).
International Preliminary Report on Patentability from related PCT Application PCT/US2008/005382, dated May 2, 2007 (12 pgs).
International Preliminary Report on Patentability from related PCT Application PCT/US2008/000703, dated Jan. 19, 2007 (11 pgs).

* cited by examiner

TILED TRANSITION BRACKETING

RELATED APPLICATIONS

The present patent application is a continuation of U.S. patent application Ser. No. 12/752,315, Filed on Apr. 1, 2010, now U.S. Pat. No. 8,171,685, which claims the benefit of U.S. patent application Ser. No. 11/799,537 filed on May 2, 2007, which is a continuation in part (CIP) of U.S. patent application Ser. No. 11/655,541, filed on Jan. 19, 2007, now U.S. Pat. No. 7,712,271, the disclosures of which are incorporated in their entirety herein by reference.

BACKGROUND

In the field of surface covering installation, it can be desirable and/or beneficial to provide transitions between the surface coverings of surfaces forming inside corners. Such inside corners are often at right angles, although inside corners can include surfaces joining at angles greater than or less than ninety degrees. Examples of surfaces forming inside corners include, a wall surface forming an inside corner with another wall surface, a wall surface forming an inside corner with a floor surface, a wall surface forming an inside corner with a ceiling surface, and a backsplash surface forming an inside corner with a countertop surface, among others.

Providing transitions between the surface coverings (e.g., tiles and other types of wall coverings) of surfaces forming inside corners can be aesthetically pleasing and/or can provide sanitary benefits by making the inside corner area easier to clean. In some circumstances (e.g., in commercial kitchens and/or bathrooms), an angled or curved transition between the surface coverings may be dictated by sanitation codes.

As an example, one method of providing a transition between a tiled wall surface and a tiled floor surface includes using cove base tiles. Such cove base tiles are often formed with at least a portion of the tile being formed in a curved shape. Forming the integral curve of a cove base tile can create added time and expense in the manufacturing of the tile.

As such, many tile manufacturers may not produce cove base tiles and/or may only provide cove base tiles in a limited amount of colors, sizes, and/or shapes. In such situations, one desiring to have a particular tile cove base installed may be unable to obtain the particular base or may only be able to obtain it after added expense.

Another method of providing a transition between a tiled floor and wall includes using a floor molding or profiled strip for forming a transition bridge between the floor and the wall. In such cases, the transition bridges are composed of flexible materials such as plastic or metal which remains undesirably exposed at the corner. As such, the transition bridges of these floor moldings and/or profiled strips are often of a second or third material or color/style and, therefore, do not provide uniformity/style continuity between the surface coverings (e.g., tiles) of surfaces forming inside corners.

DETAILED DESCRIPTION

The present disclosure includes various method, device, and system embodiments for forming a tiled transition by using a tiled transition bracket. One device embodiment includes a bracket for forming a tiled transition between a first surface and a second surface, the first and second surfaces forming an inside corner.

In such an embodiment, the bracket can include a first base portion securable to the first surface and a second base portion securable to the second surface. The bracket embodiment includes a receiving slot angled with respect to the first and second surfaces for receiving a tile strip, where the tile strip is permanently secured in the receiving slot to form the tiled transition between the first and second surfaces.

The first and/or second surfaces can include surface coverings such as various types of tiled coverings (e.g., ceramic tiles or wood tiles), among various other types of surface coverings. In various embodiments, the first surface covering can be different than the second surface covering. For instance, the first surface covering can be a ceramic tile covering and the second surface covering can be a wood surface covering.

In some embodiments, a tiled transition bracket system includes a first bracket for forming a tiled transition between a first surface and a second surface. In various embodiments, the first bracket includes a tile receiving slot to receive a tile strip angled with respect to the first and second surfaces and the first and second surfaces form an inside corner.

The system embodiment includes a bracket connector having a first end that includes a first connector portion sized to connect with an end of the first bracket and a second end that includes a second connector portion sized to connect with an end of a second bracket. The second bracket can include a tile receiving slot to receive a tile strip angled with respect to the first and second surfaces. In various embodiments, the first connector portion is a male connector portion to be received by the end of the first bracket and the second connector portion is a male connector portion to be received by the end of the second bracket.

In various embodiments, the system can include a third bracket for forming a tiled transition between at least a first surface and a third surface. The third bracket can include a tile receiving slot to receive a tile strip angled with respect to the first and third surfaces. In some embodiments, the first, second, and third surfaces form a three-way inside corner. In some embodiments, the first, second, and third surfaces form a three-way outside corner.

Figure 1A:
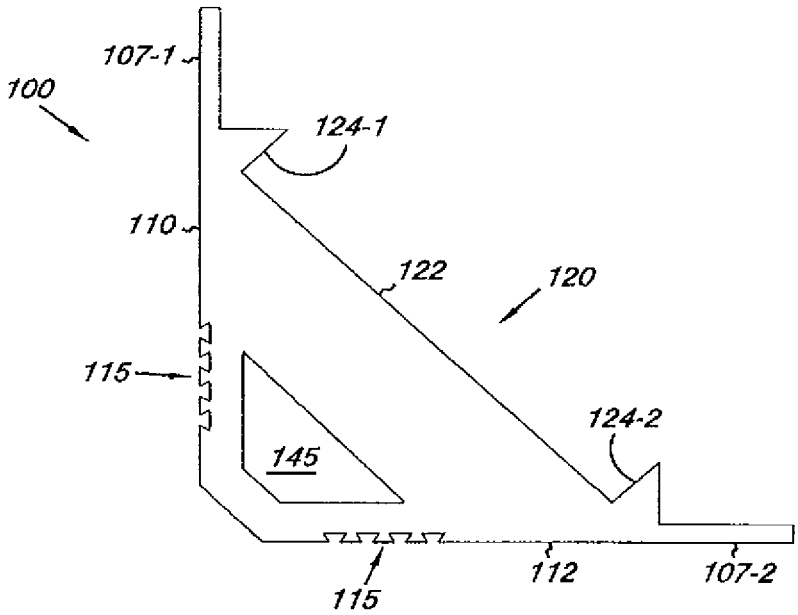
FIG. 1A illustrates a cross-sectional view of a bracket for forming a tiled transition according to an embodiment of the present disclosure.
Figure 1B:
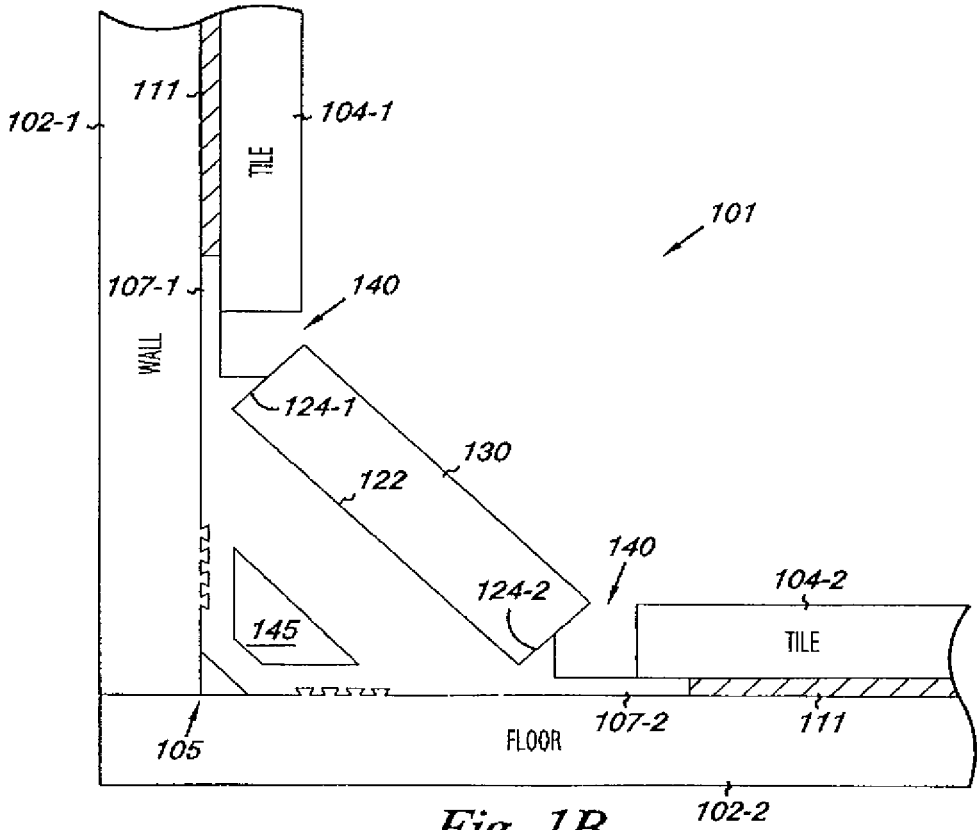
FIG. 1B illustrates a cross-sectional view of an embodiment of a tiled transition formed using the bracket of FIG. 1A.
Figure 1C:
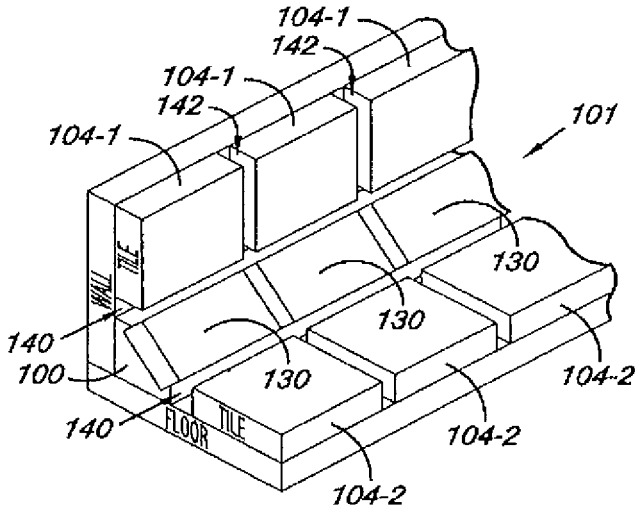
FIG. 1C illustrates a perspective view of an embodiment of a tiled transition formed using the bracket of FIG. 1A.

FIG. 1A illustrates a cross-sectional view of a bracket 100 for forming a tiled transition according to an embodiment of the present disclosure. Bracket embodiments for forming a tiled transition may be referred to herein as transition brackets and/or tiled transition brackets. FIG. 1B illustrates a cross-sectional view of an embodiment of a tiled transition 101 formed using the bracket of FIG. 1A. FIG. 1C illustrates a perspective view of a tiled transition 101 formed using bracket 100.

Various bracket embodiments of the present disclosure (e.g., bracket 100) can be formed of various materials including PVC (polyvinyl chloride), nylon plastic, carbon fiber, aluminum, and/or rubber, among various other materials. The various bracket embodiments can be formed via processes such as extrusion, molding, or machining, among other processes.

As such, bracket embodiments can have various lengths. For instance, the bracket 100 can be the length of a surface covering such as a tile (e.g., 4 inches, 6 inches, 12 inches, or 16 inches, among other lengths). In other embodiments, the bracket 100 can be formed in segments, (e.g., 2 foot, 4 foot, 6 foot, or 10 foot segments) such that the bracket is as long as several surface covering pieces (e.g., several tiles).

In the embodiment illustrated in FIGS. 1A-1C, the bracket 100 includes a first base portion 110 securable to a first surface 102-1 (e.g., a wall, as shown) and a second base portion 112 securable to a second surface 102-2 (e.g., a floor, as shown) forming an inside corner 105. In the example illustrated in FIGS. 1A-1C, the inside corner between the first and second surface forms a right angle.

However, embodiments are neither limited to a particular first and/or second surface nor to inside corners forming right angles. For instance, the first and second surfaces can both be wall surfaces (e.g., wall surfaces forming a vertical inside corner).

The first and/or second surfaces 102-1 and 102-2 can also be a ceiling surface, a countertop surface, a backsplash surface, among other surfaces. The inside corner 105 can be at an angle greater than or less than a right angle.

Figure 2A:
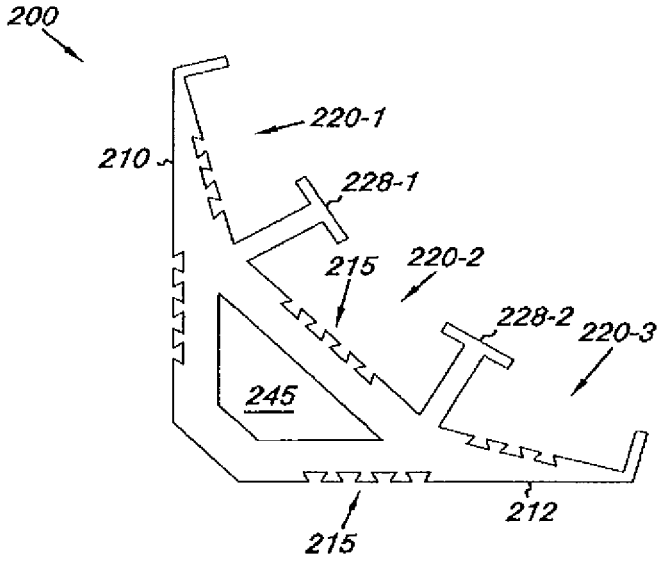
FIG. 2A illustrates a cross-sectional view of another type of bracket for forming a tiled transition according to an embodiment of the present disclosure.
Figure 2B:
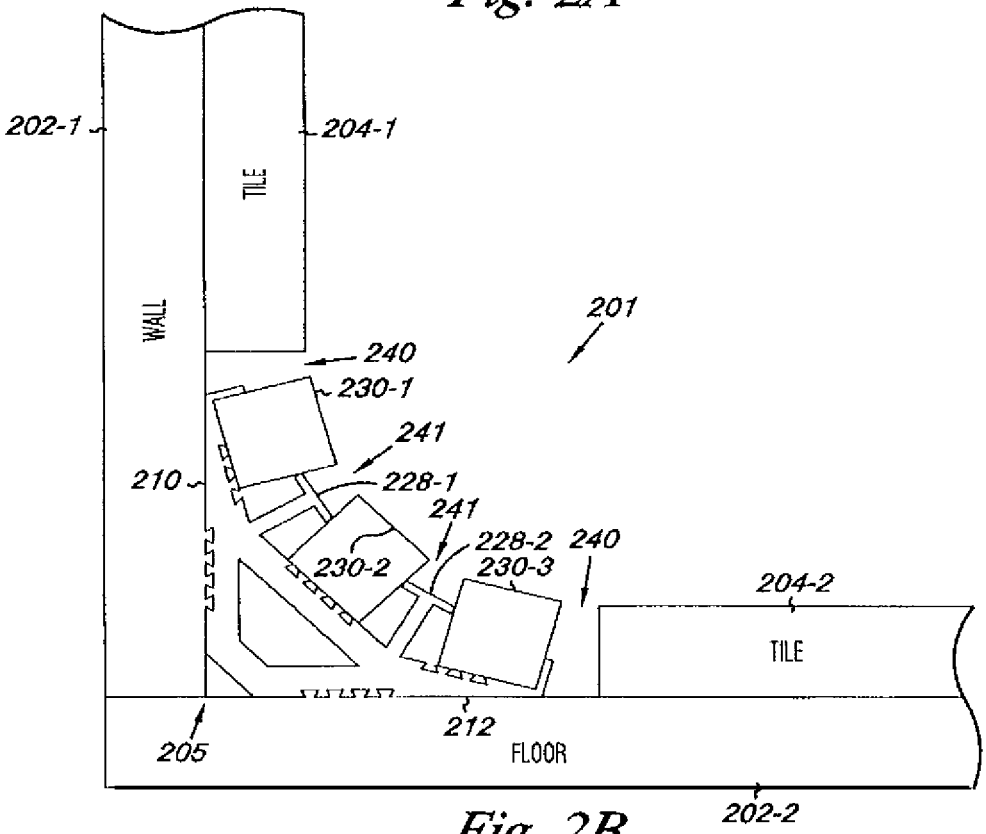
FIG. 2B illustrates a cross-sectional view of an embodiment of a tiled transition formed using the bracket of FIG. 2A.

In the embodiment illustrated in FIGS. 1A-1C, the bracket 100 includes a receiving slot 120 angled with respect to the first and second surfaces 102-1 and 102-2 and located between first and second base portions 110 and 112. In such embodiments, the bracket 100 can include a single slot 120 that is defined by engagement surfaces 122, 124-1, and 124-2. In various embodiments, and as shown in FIGS. 2A-2B, the bracket can include more than one receiving slot (e.g., 2, 3, 4, or more).

The receiving slot illustrated in the embodiment shown in FIGS. 1A-1C is angled at 45 degrees with respect to the surface 102-1 and 102-2 (e.g., the tiled transition 101 forms an interior transition angle of 135 degrees with respect to the surfaces 102-1 and 102-2). As the reader will appreciate, various other transition angles can be used in the embodiments of the present disclosure (e.g., the receiving slot 120 can be oriented at various other angles).

In the embodiment shown in FIGS. 1A-1C, the bracket 100 also includes a number of channels or grooves 115 in base portions 110 and 112. The channels 115 can be beneficial for ensuring secure bonding of bracket 100 to the surfaces 102-1 and 102-2 via a suitable bonding material such as a thin-set mortar or other adhesive bonding material.

In various embodiments, the bracket 100 can be mechanically fixed to surfaces 102-1 and/or 102-2. For example, embodiments can be nailed and/or screwed to the surfaces in addition to or in substitution for an adhesive material.

In various embodiments, the bracket can include one or more legs extending parallel to the first and/or second surface. In such embodiments, at least a portion of the one or more legs can be covered by a surface covering (e.g., a tile covering) of the surface.

For instance the bracket 100 includes a first leg 107-1 extending parallel to the first surface 102-1 and a second leg 107-2 extending parallel to the second surface 102-2. As shown in FIG. 1B, a portion of the first leg 107-1 is covered by surface covering 104-1 and a portion of the second leg 107-2 is covered by a second surface covering 104-2.

In various embodiments, the legs 107-1 and/or 107-2 can be secured to the respective surface 102-1 and 102-2 via a thin-set mortar 111, other adhesive bonding material, and/or a mechanical fastening mechanism, such as one or more screws and/or nails. In some embodiments, the legs can include channels (e.g., channels 115) or can be perforated to facilitate mechanical bonding to surface 102-1 and/or 102-2. As discussed above, the legs 107-1 and 107-2 may also be secured to the surfaces 102-1 and 102-2 via fasteners (e.g., screws, nails, and/or staples) in addition to, or in lieu of an adhesive bonding material.

The engagement surface (e.g., 122 of receiving slot 120) can also include channels (e.g., similar to channels 115) therein that can be used to securely bond a tile strip 130 to the bracket 100. The channels can have various different shapes and configurations to facilitate a mechanical bond between the transition bracket and a surface (e.g., surface 102-1 and 102-2) and/or between the transition bracket and a tile strip (e.g., tile strip 130).

In some embodiments, the engagement surfaces 122, 124-1, and/or 122-2 can be modified (e.g., treated or manipulated with tools) to facilitate an adequate bond of a thin-set or other bonding material to the bracket. For example, in some embodiments, the adhesion properties of a surface can be improved by exposure to heat, one or more chemicals, and/or other treatment techniques. In some embodiments, a surface can be manipulated, such as by etching or sanding to improve the adhesion properties of the surface.

In some embodiments, the engagement surfaces 122, 124-1, and/or 122-2 can include a bonding material such as a fiberglass coating or other bonding material to facilitate a suitable bond of the tile strip 130 in the receiving slot 120. For example, in some embodiments, the bracket can be made of polyvinyl chloride (PVC), which some types of thin-set mortar may not adequately bond to.

In such instances, portions of, or the entire, bracket can be coated with a bonding agent or intermediate material to facilitate an adequate bond of a thin-set or other bonding material to the bracket. In this manner, a tile strip can be permanently secured to the bracket by using a thin-set mortar or other bonding material.

For example, an intermediate material can be a material having better adhesion qualities than PVC, with respect to the adhesion of thin-set material. The intermediate material can be adhered to the PVC in any suitable manner and the tile can then be adhered using thin-set adhesive material to the intermediate material. Such techniques can be utilized for other types of suitable adhesive materials by using a suitable intermediate material to provide a suitable surface for adhering the tile.

The receiving slot 120 of bracket 100 and tile strip 130, to be secured therein, can have various sizes. As an example, the slot 120 can have a width (e.g., a distance between engagement surface 124-1 and engagement surface 124-2) of about 0.5 inches to 1.75 inches to accommodate a tile strip having a width of about the same size. Embodiments are not so limited to a particular width dimension of the tile receiving slot and/or tile strip and can be considerably larger or smaller.

In various embodiments, more than one tile strip can be placed in a receiving slot (e.g., slot 120). For example, two tile strips could be secured in receiving slot 120. In such embodiments, the tile strips can include a space (e.g., a grout joint) therebetween. For instance, if the receiving slot had a width of about 1.75 inches, the two tile strips could each have a width of about 0.75 inches with a grout joint of about 0.25 inches between the strips.

In various embodiments, the tile strip can be permanently bonded (e.g., permanently secured) in a receiving slot prior to installation of the bracket (e.g., before the bracket 100 is permanently secured to surfaces 102-1 and 102-2). In some embodiments, the bracket 100 can be secured to the surfaces 102-1 and 102-2 prior to the securing of tile strip 130 within receiving slot 120.

In the embodiment illustrated in FIG. 1, the bracket 100 and tile strip 130 secured thereto form a tiled transition 101 between a number of first surface covering elements 104-1 and a number of second surface covering elements 104-2. In such embodiments, the tiled transition 101 can be between two tile surfaces (e.g., tile covering 104-1 on wall surface 102-1 and tile covering 104-2 on floor surface 102-2). The tile coverings 104-1 and 104-2 can be permanently secured to the respective surfaces 102-1 and 102-2 via a bonding material 111 (e.g., a thin-set mortar, mastic, glue, or other adhesive material).

In some embodiments, the tile strip may be the same type of tile as tile coverings. For example, a tile strip can be cut from one or more of the tiles used to cover the surfaces (e.g., surface 102-1 and/or 102-2) using a suitable cutting device (e.g., a wet or dry tile saw). In some embodiments, the tile strip can be formed to a suitable size during manufacture.

In various embodiments, the tile strip used to form the tiled transition can be a different type of material than tile 104-1 and/or 104-2 and/or may have a different color. As an example, the tile 104-1 and/or 104-2 may be a material such as slate or marble, while the tile strip 130 can be a material such as granite, among various other materials.

In various embodiments, and as shown in FIG. 1C, the tile strip 130 can have a length that is the same as the length of the tiles 104-1 and/or 104-2. In such embodiments, the tiled transition 101 can be formed such that a continuous grout joint (e.g., a grout joint 142) occurs between surface coverings 104-1 and 104-2.

A grout joint refers to a gap between individual tiles and/or tile strips that can be filled with a filler material (e.g., a sanded or unsanded grout material or caulking, among various other filler materials). In some embodiments, the tile strips 130 can be staggered and/or have a length different than surface covering 104-1 and/or 104-2 such that grout joint 142 is not continuous (e.g., straight) between the two surface coverings.

In the embodiment shown in FIGS. 1B and 1C, a grout joint 140 is depicted between the tile strip 130 and the surface coverings 104-1 and 104-2. In some embodiments, the surface coverings adjacent the tile strip 130 (e.g., tile 104-1 and 104-2 in the example of FIGS. 1B and 1C) may abut the tile strip such that no grout joint 140 exists.

Figure 4:
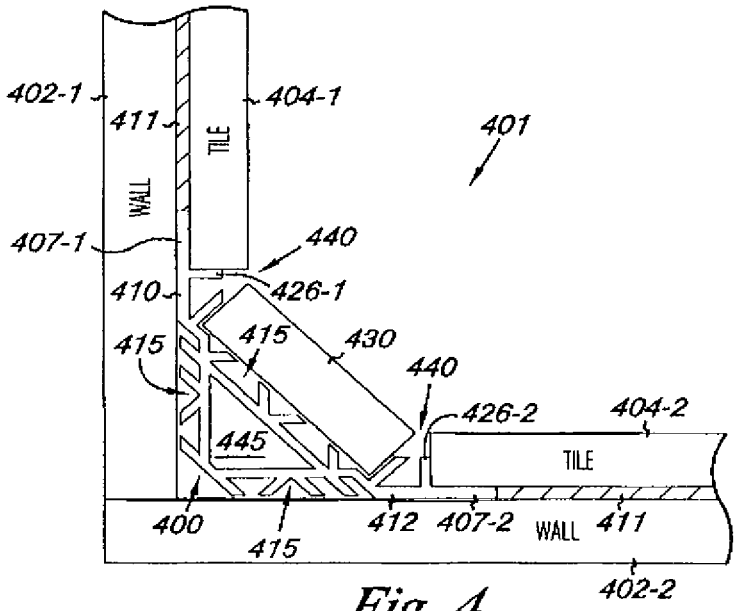
FIG. 4 illustrates a cross-sectional view of a tiled transition using a bracket embodiment in accordance with present disclosure.

In some embodiments (e.g., as shown in FIG. 4) one or both of the first and second base portions (e.g., 110 and 112) may include a spacer member located a distance from the receiving slot (e.g., 120). In such embodiments, the spacer member can extend out from a base portion of the bracket (e.g., perpendicular to the surface (e.g., 102-1 and 102-2) to which the base portion is secured).

As described below, the spacer member can be used to maintain a grout joint (e.g., 140) between a tile strip (e.g., 130) and a surface covering (e.g., 104-1 and 104-2). The spacer member can also be used as a support member to support one or more surface coverings (e.g., tiles) as other surface coverings are secured to a surface (e.g., a wall surface). Such embodiments can therefore, provide support to tile mounted vertically, for example, which may aid in mounting tile and in the length of time needed for adhesion.

Also, the support member may provide a straight surface for guiding the placement of tile on a surface. As such, some embodiments may aid in the speed of tile placement, among other benefits.

In various embodiments, the bracket 100 can be designed to be unviewable when the tiled transition 101 has been grouted (e.g., when grout joints 140 and 142 have received a filler material therein). The unviewable nature of such embodiments can be desirable and/or beneficial. For instance, one desiring to have a tiled transition (e.g., tiled transition 101) between two tiled surfaces (e.g., tiled surfaces 102-1 and 102-1) may not want to have a viewable transition made of a material other than a tile material (e.g., a material such as a metal or plastic).

In some embodiments, such as the embodiment shown in FIG. 3 and described below, a portion of the bracket may be visible when the tiled transition has been grouted. As described below, in such embodiments, the visible portion of the bracket may be a portion of one or more spacer or support members of the bracket.

The visible portion may be made of various materials such as metals or colored plastics and can provide a profile strip in place of one or more grout joints (e.g., joints 140). Such profile strips can be designed to be decorative in nature, in some embodiments.

In various embodiments of the present disclosure, as described further herein, the bracket can include a connector portion on at least one of a first or second end of the bracket. The connector portion(s) can be used, for example, to connect with other transition brackets and/or other connection components of a tiled transition bracket system. In the embodiment illustrated in FIGS. 1A-1C, the bracket 100 includes a connector portion 145. In the embodiment illustrated in FIGS. 1A-1C, the connector portion 145 is a female connector for receiving a male connector portion thereto (e.g., a male portion of a bracket connector such as those shown in FIGS. 6A-10 or a male connector portion of another bracket). In various embodiments, and as shown in FIGS. 1A and 1B, the female connector portion 145 can be a hollow portion formed at one or both ends of or through a length of the bracket 100 between a first end and second end of the bracket. In various bracket embodiments in which the connector portion (e.g., 145) is formed through a length of the bracket, electrical wiring can be placed within the hollow region. In some embodiments, the wiring can be used for providing power to one or more lighting elements. In such embodiments, the lighting elements can be connected to various portions of the bracket and/or can be placed through an aperture formed in a tile strip secured in a slot (e.g., slot 120).

In some embodiments, the first end and/or the second end of the bracket can include a male connector portion that can be received by (e.g., mated with) a female connector portion of a bracket connector and/or to a female connector portion of a different bracket. That is, embodiments of the present disclosure are not limited to brackets having female connector portions.

The connector portion of the bracket can have various shapes. In the embodiment shown in FIGS. 1A and 1B, the connector portion 145 has a trapezoidal shape. However, embodiments are not limited to a particular shape of connector portion 145. For instance, various bracket embodiments can have a connector portion with a circular shape, a square shape, a triangular shape, or a star shape, among other regular or irregular shapes. In some embodiments, the shape of a male connector portion is not the same shape as the female connector portion.

Also, embodiments of the present disclosure are not limited to a particular mechanism for connecting various components. For instance, embodiments are not limited to the use of a male/female type connection mechanism to connect adjacent transition brackets or to connect a bracket to a bracket connector (e.g., a bracket connector described in FIGS. 8A-10). Other types of connection mechanisms can include a ball and socket mechanism or a bonding agent such as an adhesive, for example.

In some embodiments, various tiled transition bracketing components (e.g., various transition brackets shown in FIGS. 1A-5B and/or corner components shown in FIGS. 8A-10), can be connectorless. In embodiments in which the bracketing components are connectorless, the end surfaces of adjacent brackets and/or an end surface of a bracket and adjacent corner component may be secured to each other via an adhesive such as glue. In some embodiments in which the bracketing components are connectorless, the end surfaces of adjacent brackets and/or corner components may abut each other but may not be bonded together.

FIG. 2A illustrates a cross-sectional view of another type of bracket 200 for forming a tiled transition according to an embodiment of the present disclosure. FIG. 2B illustrates a cross-sectional view of an embodiment of a tiled transition 201 between a first surface 202-1 and a second surface 202-2 formed using the bracket of FIG. 2A. In the embodiment illustrated in FIGS. 2A and 2B, the first and second surfaces include respective surface coverings 204-1 and 204-2 secured thereto.

In the embodiment illustrated in FIGS. 2A-2B, the bracket 200 includes a first base portion 210 securable to the first surface 202-1 (e.g., a wall, as shown) and a second base portion 212 securable to the second surface 202-2 (e.g., a floor, as shown) forming an inside corner 205.

In various embodiments, the bracket can include a number of receiving slots between the first and second base portions for receiving tile strips to form the tiled transition 201. In the embodiment of FIGS. 2A and 2B, the bracket 200 includes three receiving slots 220-1, 220-2, and 220-3 for receiving tile strips 230-1, 230-2, and 230-3, respectively. The receiving slots are each angled with respect to the first and second base portions 210 and 212. In various embodiments, and as shown in FIGS. 2A and 2B, the receiving slots can each be angled with respect to each other.

In various embodiments, the tiled transition can be a coved (e.g., rounded) transition. That is, the tile strips can form a coved transition when secured in the receiving slots.

The radius of curvature of the tiled transition can depend on various factors such as the number of receiving slots in the bracket and/or the width of the receiving slots and/or the tile strips, among various other factors. For instance, in some embodiments, the coved transition can have a radius of curvature of, for example, more than ⅜ inch. Such embodiments may be beneficial in use where health codes enforcing such cove radius regulations are enforced, such as in restaurants and other establishments.

In various embodiments, the bracket can include one or more spacer members formed between the receiving slots. In the embodiment of FIGS. 2A and 2B, the bracket 200 includes a first spacer member 228-1 formed between receiving slots 220-1 and 220-2 and a second spacer member 228-2 formed between receiving slots 220-2 and 220-3.

The size and/or shape of the spacer members 228-1 and 228-2 can any suitable dimension. In various embodiments, the spacer members can be used to maintain a particular grout joint (e.g., grout joint 241) between tile strips (e.g., tile strips 230-1 to 230-3). The width of the grout joint can, for example, be ⅛ inch, 3⁄16 inch, or ¼ inch, among other widths.

In various embodiments, (and, as described in connection with FIG. 4) at least one of a first base portion and second base portion of the bracket can include a spacer member for maintaining a gap between one of the tile strips and a covering (e.g., a tile) of the surface to which the base portion is secured. For example, in the embodiment illustrated in FIGS. 2A and 2B, the base portion 210 secured to wall surface 202-1 can include a spacer member (e.g., spacer member 426-1 shown in FIG. 4) for maintaining a gap 240 (e.g., a grout joint) between tile strip 230-1 and tile 204-1.

In the embodiment illustrated in FIGS. 2A and 2B, the bracket 200 also includes a number of channels or grooves 215 in base portions 210 and 212 and in receiving slots 220-1 to 220-3 that can be used for ensuring secure bonding of bracket 200 to the surfaces 202-1 and 202-2 and/or of tile strips 220-1 to 220-3 to the bracket 200.

The embodiment illustrated in FIGS. 2A and 2B includes a connector portion 245. In the embodiment illustrated in FIGS. 2A and 2B, the connector portion 245 is a female connector for receiving a male connector portion thereto (e.g., a male portion of a bracket connector such as those shown in FIGS. 6-10). In various embodiments, and as shown in FIGS. 2A and 2B, the female connector portion 245 can be a hollow portion formed at one or both ends of or through a length of the bracket 200 between a first end and second end of the bracket.

Figure 3:
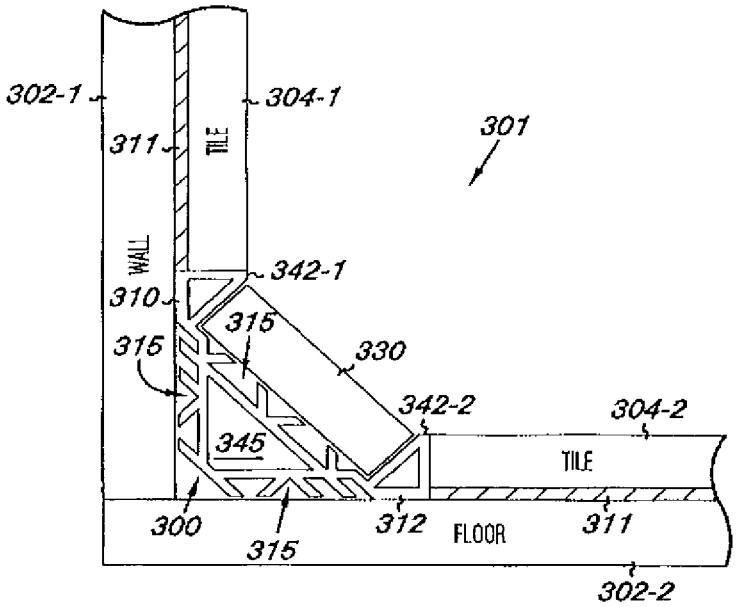
FIG. 3 illustrates a cross-sectional view of a tiled transition using a bracket embodiment in accordance with present disclosure.

FIG. 3 illustrates a cross-sectional view of a tiled transition 301 using a bracket embodiment 300 in accordance with present disclosure. The tiled transition 301 is a tiled transition between a first surface covering 304-1 of a first surface 302-1 and a second covering 304-2 of a second surface 302-2. In the embodiment of FIG. 3, the first surface covering 304-1 and the second surface covering 304-2 are tiles secured to respective surfaces with a bonding material 311 (e.g., thin-set mortar, glue, mastic, etc.).

In the embodiment illustrated in FIG. 3, the bracket 300 includes a first base portion 310 securable to the first surface 302-1 (e.g., a wall, as shown) and a second base portion 312 securable to the second surface 302-2 (e.g., a floor, as shown). The bracket 300 also includes a number of grooves 315 that can facilitate bonding of the bracket to the surfaces 302-1 and 302-2 and/or bonding of a tile strip 330 to the receiving slot of bracket 300.

In the embodiment of FIG. 3, the bracket 300 includes two spacer members 342-1 and 342-2 that maintain a gap between tile strip 330 and the adjacent tile coverings 304-1 and 304-2, respectively. The spacer members 342-1 and 342-2 can also be used as a support member to prevent one or more surface coverings (e.g., tile 304-1) from sliding down a wall due to gravity when the surface covering is being installed, for example. Such surfaces can also be used as a guide for setting a covering on a surface, as discussed above.

In the embodiment illustrated in FIG. 3, the spacer members 342-1 and 342-2 are viewable when the tiled transition 301 has been grouted. The visible portion may be made of various materials such as metals or colored plastics and can provide a profile strip in place of one or more grout joints (e.g., joints 140 shown in FIG. 1C).

The embodiment illustrated in FIG. 3 includes a connector portion 345. In the embodiment illustrated in FIG. 3, the connector portion 345 is a female connector for receiving a male connector portion thereto (e.g., a male portion of a bracket connector such as those shown in FIGS. 6-10). In various embodiments, and as shown in FIG. 3, the female connector portion 345 is a hollow portion formed through a length of the bracket 300 between a first end and second end of the bracket.

FIG. 4 illustrates a cross-sectional view of a tiled transition 401 using a bracket embodiment 400 in accordance with present disclosure. The tiled transition 401 is a tiled transition between a first surface covering 404-1 of a first surface 402-1 and a second covering 404-2 of a second surface 402-2. In the embodiment for FIG. 4, the first surface covering 404-1 and the second surface covering 404-2 are tiles secured to respective surfaces with a bonding material 411 (e.g., thin-set mortar, glue, mastic, etc.).

In the embodiment illustrated in FIG. 4, the bracket 400 includes a first base portion 410 securable to the first surface 402-1 (e.g., a wall, as shown) and a second base portion 412 securable to the second surface 402-2 (e.g., a different wall, as shown). The bracket 400 also includes a number of grooves 415 that can facilitate bonding of the bracket to the surfaces 402-1 and 402-2 and/or bonding of a tile strip 430 to the receiving slot of bracket 400.

In the embodiment illustrated in FIG. 4, the first and second base portions 410 and 412 include a spacer member 426-1 and 426-2, respectively. The spacer members 426-1 and 426-2 are located a distance from the receiving slot of bracket 400 and extend out from base portions 410 and 412.

The spacer members can be used to maintain a grout joint 440 between tile strip 430 and surface coverings 404-1 and 404-2. The spacer members can also be used as a support member to support one or more surface coverings as described above. In the embodiment of FIG. 4, the spacer members 426-1 and 426-2 are perpendicular to the respective surfaces 402-1 and 402-2, but embodiments are not limited to perpendicularly extending spacer members.

In the embodiment of FIG. 4, the bracket 401 includes a first leg 407-1 extending parallel to the first surface 402-1 and a second leg 407-2 extending parallel to the second surface 402-2. The first leg 407-1 is covered by surface covering 404-1 and the second leg 407-2 is covered by a second surface covering 404-2.

The legs 407-1 and/or 407-2 can be secured to the respective surface 402-1 and 402-2 via a suitable bonding material 411. In some embodiments, the legs can include channels (e.g., channels 415) or can be perforated to facilitate mechanical bonding to the surface. The legs 407-1 and 407-2 may also be secured to the surfaces 402-1 and 402-2 via screws and/or staples in addition to, or in lieu of an adhesive bonding material, as discussed above.

The embodiment illustrated in FIG. 4 includes a connector portion 445. In the embodiment illustrated in FIG. 4, the connector portion 445 is a female connector for receiving a male connector portion thereto (e.g., a male portion of a bracket connector such as those shown in FIGS. 6-10). In various embodiments, and as shown in FIG. 4, the female connector portion 445 is a hollow portion formed through a length of the bracket 400 between a first end and second end of the bracket.

Figure 5A:
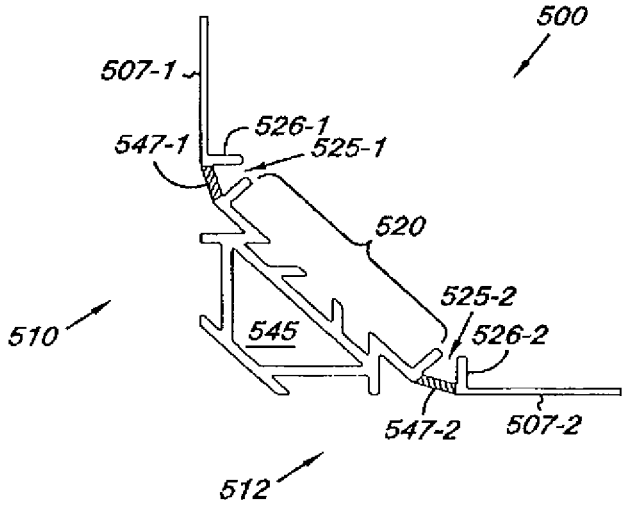
FIG. 5A illustrates a cross-sectional view of a bracket for forming a tiled transition according to an embodiment of the present disclosure.
Figure 5B:
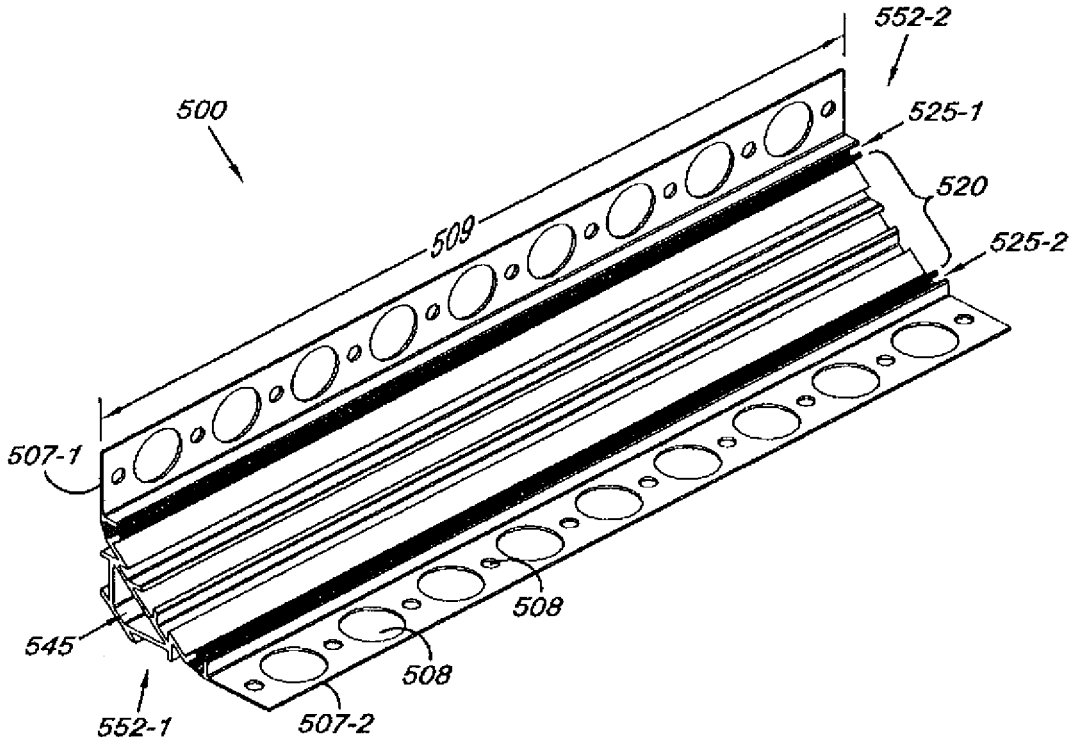
FIG. 5B illustrates a perspective view of the bracket shown in FIG. 5A.

FIG. 5A illustrates a cross-sectional view of a bracket 500 for forming a tiled transition according to an embodiment of the present disclosure. FIG. 5B illustrates a perspective view of the bracket 500 shown in FIG. 5A.

In the embodiment illustrated in FIGS. 5A and 5B, the bracket 500 includes a first base portion 510 securable to a first surface (e.g., a wall, a floor, a ceiling, a backsplash, a counter top, among other surfaces) and a second base portion 512 securable to a second surface (e.g., a different wall or other surface). As described above, in various embodiments the first and second surfaces form an inside corner (e.g., an inside corner between a wall surface and a floor surface or an inside corner between two different wall surfaces).

The embodiment illustrated in FIGS. 5A and 5B includes a receiving slot 520 for receiving one or more tile strips (not shown) to form a tiled transition between two surfaces. The embodiment illustrated in FIGS. 5A and 5B, also includes a first channel 525-1 and a second channel 525-2 adjacent the receiving slot 520. The channels 525-1 and 525-2 are elongate channels for receiving a filler material subsequent to a tile strip being adhered in the receiving slot 520. That is, channels 525-1 and 525-2 can provide a recessed portion to receive a filler material (e.g., a grout or caulking material) between a tile strip (e.g., 430 shown in FIG. 4) and a surface covering (e.g., 404-1 or 404-2 shown in FIG. 4). In the embodiment illustrated in FIGS. 5A and 5B, the channels 525-1 and 525-2 formed in bracket 500 are parallel to the receiving slot 520.

In the embodiment illustrated in FIGS. 5A and 5B, the first and second base portions 510 and 512 include respective spacer members 526-1 and 526-2, as well as respective legs 507-1 and 507-2. In various embodiments, and as shown in FIGS. 5A and 5B, the spacer members 526-1 and 526-2 are located a distance from the receiving slot 520 of bracket 500 and extend outward from base portions 510 and 512, respectively. As shown in FIGS. 5A and 5B, the spacer members can define a portion of the channels 525-1 and 525-2 and can be used to maintain a space (e.g., a joint to receive a filler material) between a tile strip (e.g., 430 shown in FIG. 4) and a surface covering (e.g., 404-1 or 404-2 shown in FIG. 4). The spacer members can also be used as support members to support one or more surface coverings as described above.

In the embodiment of FIG. 5, the first leg 507-1 extends parallel to a first surface to which the bracket 500 is to be secured, and the second leg 507-2 extends parallel to a second surface to which the bracket 500 is to be secured. As shown in FIG. 4 above, the first leg 507-1 can be covered by a first surface covering (e.g., a tile) and the second leg 507-2 can be covered by a second surface covering. In various embodiments, and as shown in FIG. 5B, the legs 507-1 and/or 507-2 can include a number of apertures 508 therein that can facilitate mechanical bonding to a surface. As shown in the embodiment of FIGS. 5A and 5B, the apertures 508 can have different sizes and/or shapes. In some embodiments, the legs 507-1 and/or 507-2 can be secured to the walls with nails and/or screws through one or more of the apertures 508.

As previously mentioned, various bracket embodiments of the present disclosure can be formed of various materials including PVC (polyvinyl chloride), nylon plastic, carbon fiber, aluminum, and/or rubber, among various other materials. In various embodiments, the bracket can be made of more than one material. For instance, in some embodiments, one or more portions of the bracket can be formed of a different material than the rest of the bracket.

In the embodiment shown in FIGS. 5A and 5B, a portion 547-1 of channel 525-1 and a portion 547-2 of channel 525-2 is formed of a different material than the rest of bracket 500. As an example, the bracket 500 can be formed of a first material which is less flexible than channel portions 547-1 and/or 547-2, which are formed of a different material.

Forming the channel portions of a more flexible material than the rest of the bracket can provide several benefits. For instance, forming the channel portions of a more flexible material can provide an expansion joint which can expand and contract with temperature variations. In some cases, forming the channel portions of a flexible material can reduce and/or prevent damage (e.g., cracking) to surface coverings and/or filler material (e.g., caulking or grout) within the channels.

In various embodiments, the channel portions 547-1 and/or 547-2 are not permanently secured to a surface. For instance, in some embodiments, the channel portions are not adhered to a surface (e.g., a wall, a floor, etc.) even when the base portions 510 and/or 512 are secured to the surface upon installation of the bracket. In embodiments in which the channel portions 547-1 and/or 547-2 are not secured to the surface upon installation, forming the channel portions of a flexible material can provide various benefits.

For example, the flexibility of the channel portions can allow movement (e.g., bending) of the legs (e.g., 507-1 and/or 507-2) away from a surface even when base portions 510 and/or 512 have been secured to a wall surface, a floor surface, etc. (e.g., the flexible channel portions can serve as a flexible joint between the legs and the base of the bracket). In such embodiments, the ability of the legs to bend via the flexible channel portions can provide benefits such as increasing the ability of the legs to conform to an uneven installation surface (e.g., a surface which may have irregularities such as flaws or bumps, among other irregularities).

The ability of the legs to bend via the flexible channel portions can allow an adhesive such as thin set mortar, caulking, or other adhesive to be placed beneath the legs even when the base portions of the bracket have been secured in a corner. For example, an installer can use an edge of a trowel to lift a leg of a bracket that has been secured to two surfaces (e.g., a floor and a wall) in order to place a thin set mortar therebeneath when surface coverings, such as ceramic tiles, are being installed adjacent to the transition bracket (e.g., at the time when a ceramic tile is being secured upon leg 507-1/507-2 and an edge of the tile abuts spacer member 526-1/526-2).

In some embodiments, the first material can be a rigid plastic material (e.g., a rigid PVC material), and the different material (e.g., the more flexible material used to form channel portions 547-1 and 547-2) can be an elastomeric material. In the embodiment illustrated in FIGS. 5A and 5B, the bracket is formed of a rigid PVC material and the channel portions 547-1 and 547-2 are formed of alcryn. Forming the channel portions of alcryn, which is a melt-processible rubber can provide various benefits. For instance, alcryn can adhere better to various rigid plastic materials such as rigid PVC than other elastomeric materials (e.g., non melt-processible materials). Also, alcryn can be bonded to various rigid plastic materials via co-extrusion or co-injection molding, which can provide for decreased manufacturing time and/or costs associated with manufacturing various bracket embodiments of the present disclosure.

In the embodiment illustrated in FIG. 5B, the bracket 500 has a length 509. As mentioned above, bracket embodiments can have various lengths. For instance, the bracket 500 can be the length of a surface covering such as a tile (e.g., 4 inches, 6 inches, 12 inches, or 16 inches, among other lengths). In other embodiments, the bracket 500 can be formed in segments, (e.g., 2 foot, 4 foot, 8 foot, or 12 foot segments) such that the bracket is as long as several surface covering pieces (e.g., several tiles).

In various embodiments of the present disclosure, the bracket includes a connector portion on at least one of a first end and a second end of the bracket. In the embodiment illustrated in FIGS. 5A and 5B, the bracket 500 includes a connector portion 545 at a first end 552-1 and a second end 552-2 of the bracket 500. In the embodiment illustrated in FIG. 5B, the connector portion 545 is a female connector for receiving a male connector portion thereto (e.g., a male portion of a bracket connector such as those shown in FIGS. 6-10). In various embodiments, and as shown in FIG. 5B, the female connector portion 545 is a hollow portion formed through the length 509 of the bracket 500 between the first end 552-1 and second end 552-2. In some embodiments, the first end and/or the second end of the bracket can include a male connector portion that can be received by (e.g., mated with) a female connector portion of a bracket connector and/or to a female connector portion of a different bracket. That is, embodiments are not limited to brackets having female connector portions.

The connector portion of the bracket can have various shapes. In the embodiment shown in FIGS. 5A and 5B, the connector portion 545 has a trapezoidal shape. However, embodiments are not limited to a particular shape of connector portion 545. For instance, various bracket embodiments can have a connector portion with a circular shape, a square shape, a triangular shape, or a star shape, among other regular or irregular shapes.

Figure 6A:
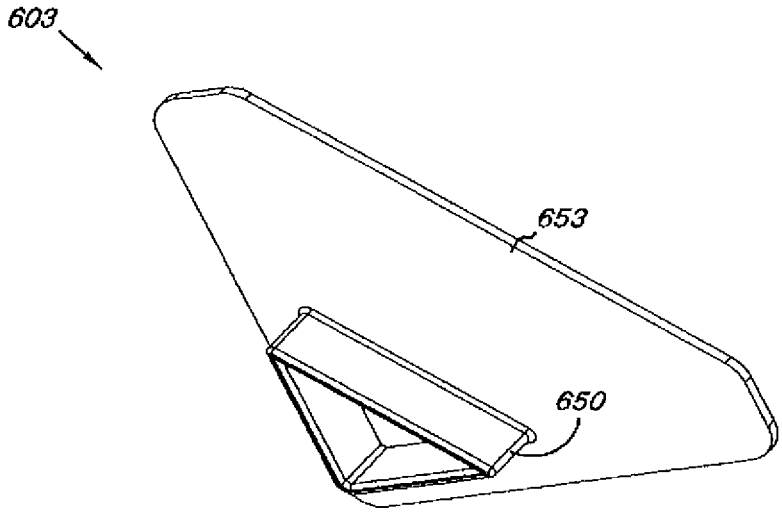
FIG. 6A illustrates a perspective view of a bracket connector for use in a tiled transition bracket system according to an embodiment of the present disclosure.
Figure 6B:
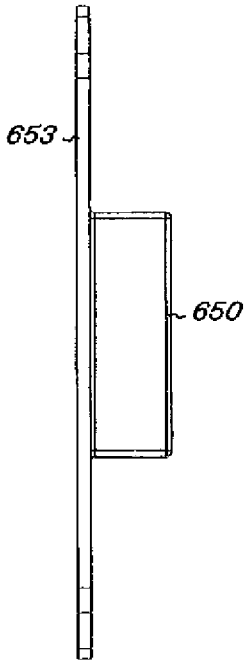
FIG. 6B illustrates another perspective view of the bracket connector shown in FIG. 6A.

FIG. 6A illustrates a perspective view of a bracket connector 603 for use, for example, in a tiled transition bracket system according to an embodiment of the present disclosure. FIG. 6B illustrates another perspective view of the bracket connector 603 shown in FIG. 6A. In the embodiment illustrated in FIGS. 6A and 6B, the bracket connector is an end cap type connector 603. Other types of connectors are also discussed herein.

As illustrated in the embodiment of FIGS. 6A and 6B, the end cap 603 includes a male connector portion 650 sized to mate with a female connector portion of a transition bracket (e.g., female connector portion 545 of bracket 500 described above) and a capping portion 653. As discussed above with respect to the connector portion of FIG. 1A, the shape of the connector portion 650 can have various shapes, which may or may not be the same as the connector portion of the bracket to which the end cap is to be connected. That is, although the connector portion 650 in the embodiment of FIGS. 6A and 6B has a trapezoidal shape, embodiments are not limited to a particular shape. In some embodiments, the shape of a male connector portion is not the same shape as the female connector portion.

Also, as discussed above, embodiments of the present disclosure are not limited to a particular mechanism for connecting various components. For instance, embodiments are not limited to the use of a male/female type connection mechanism. Other types of connection mechanisms can include a ball and socket mechanism, puzzle piece type connections, etc.

In the embodiment of FIGS. 6A and 6B, the male connector portion 650 can be inserted into a female connector portion at an end of a transition bracket in order to cap the end of a bracket. The connector portions of the end cap and bracket to which the end cap is mated can be secured in various manners. For instance, in some embodiments, frictional force between the male and female connector portions may be sufficient to suitably mate the connector portions. In some embodiments, a bonding agent, such as glue, may be used to mate the connector portions. Embodiments are not limited to a particular manner of mating the end cap connector portion to a bracket connector portion.

The various connector embodiments discussed herein can be formed of various materials including PVC, nylon plastic, carbon fiber, aluminum, stainless steel, and/or rubber, among various other materials. In some embodiments, the connector can be formed of the same or different material as the bracket to which it is secured. For instance, in some embodiments, the end cap and the bracket may both be formed of a rigid plastic material such as rigid PVC. In some embodiments, the connector portion (e.g., 650) and the capping portion (e.g., 653) can be made of different materials. The use of a more resilient material can, for example, be used where expansion and contraction may be an issue.

Capping an end of a tiled transition bracket can provide various benefits. For example, capping an end of a bracket can prevent damage to the edge of the bracket and/or can prevent damage to the edge of a tile strip secured in a receiving slot of the bracket. The end cap can also provide an esthetic benefit by preventing an edge of the bracket (e.g., an edge of the tiled transition) from being visible when the bracket is installed. An end cap can also be beneficial by providing a larger and/or more uniform bonding surface that can be used to bond the bracket to a surface.

Figure 7:
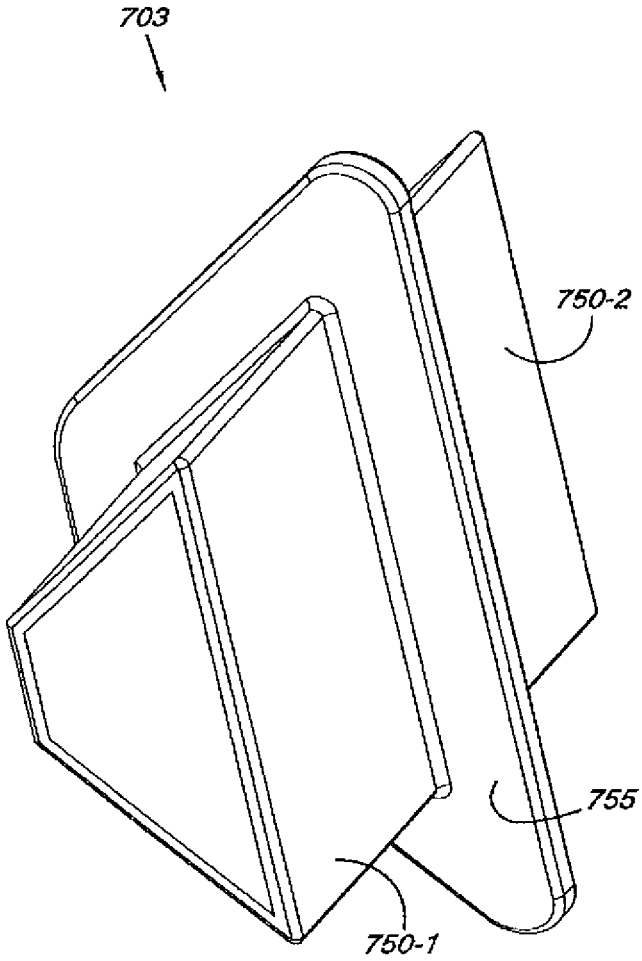
FIG. 7 illustrates a bracket connector according to an embodiment of the present disclosure.

FIG. 7 illustrates a bracket connector 703 for use in a tiled transition bracket system according to an embodiment of the present disclosure. In various embodiments of the present disclosure and as shown in the embodiment illustrated in FIG. 7, the tiled transition bracket connector 703 includes a first end sized to connect with an end of a first transition bracket and a second end sized to connect with an end of a second transition bracket.

In the embodiment of FIG. 7, the bracket connector 703 includes a base 755 having a first connector portion 750-1 on a first end and a second connector portion 750-2 on a second end. In the embodiment shown in FIG. 7, the first and second connector portions 750-1 and 750-2 are male connector portions. However, embodiments are not limited to bracket connectors having male connector portions. For instance, one or both of connector portions 750-1 and 750-2 can be a female connector portion that can receive a male connector portion of a transition bracket.

The connector portions can be at various angles to each other. As illustrated in FIG. 7, the connector portions 750-1 and 750-2 can be parallel to each other. Such an embodiment can be used where the bracket connector 703 shown if FIG. 7 can connect two tiled transition brackets (e.g., two of tiled transition brackets 500 shown in FIG. 5) parallel to each other. Using a bracket connector, such as bracket connector 703, can provide various benefits. For instance, bracket connector 703 can provide proper alignment of adjacent transition brackets.

For example, consider two tiled transition brackets 500 shown in FIG. 5 connected via a bracket connector 703 (e.g., one end of a first bracket 500 is connected to connector portion 750-1 and one end of a second bracket 500 is connected to connector portion 750-2 such that the two brackets are adjacent). In this example, the connection of the two transition brackets 500 with the bracket connector 500 can provide proper alignment of adjacent tile receiving slots (e.g., 520) and adjacent channels (e.g., 525-1 and 525-2).

In some embodiments, the connector portions 750-1 and 750-2 can be angled with respect to each other. For example, in some embodiments, the connector 703 can be placed in a corner (e.g., an inside or outside corner). In such embodiments, if the corner is a square corner (e.g., a ninety degree corner) the connector portions 750-1 and 750-2 can be perpendicular to each other. In such embodiments, the connector portions can connect two adjacent transition brackets in the corner.

Providing proper alignment of adjacent transition brackets can, for example, reduce the frequency of or prevent an installer of the tiled transition from having to manually align adjacent transition brackets. Manually aligning adjacent brackets can increase installation time and/or can lead to uneven (e.g., crooked) joints between adjacent tile strips within the tile receiving slots and/or between surface coverings (e.g., field tiles) adjacent to the transition brackets, among other issues.

Figure 8A:
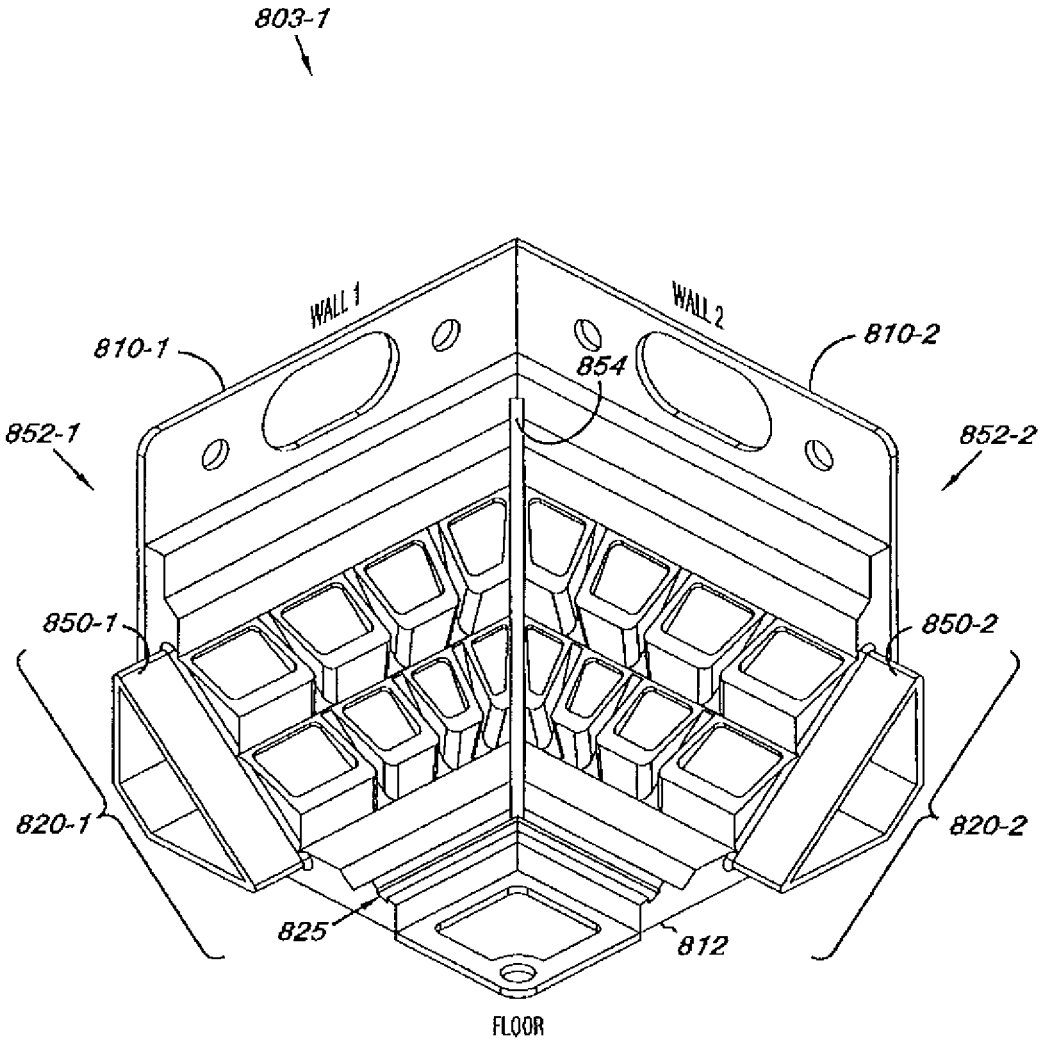
FIG. 8A illustrates another bracket connector according to an embodiment of the present disclosure.

FIG. 8A illustrates another bracket connector 803-1 according to an embodiment of the present disclosure. In the embodiment illustrated in FIG. 8A, the tiled transition bracket connector 803-1 includes a first end 852-1 having a first connector portion 850-1 sized to connect with an end of a first transition bracket and a second end 852-2 having a second connector portion 850-2 sized to connect with an end of a second transition bracket.

In various embodiments, the first and second transition brackets that are connected by the bracket connector (e.g., connector 803-1) include a tile receiving slot for forming a tiled transition between a first surface and a second surface. As described above, in various embodiments, the first and the second surfaces form an inside corner (e.g., an inside corner between a wall surface and a floor, ceiling, or counter surface or an inside corner between two wall surfaces).

In the embodiment shown in FIG. 8A, the first and second connector portions 850-1 and 850-2 can be male connector portions that can be received by a female connector portion of an end of a first and second transition bracket, respectively. However, as noted above, embodiments are not limited to bracket connectors having male connector portions or to transition brackets having female connector portions.

In the embodiment shown in FIG. 8A, the first end 852-1 and second end 852-2 of the connector 803-1 are perpendicular to each other such that connector portions 850-1 and 850-2 are perpendicular to each other. As such, the bracket connector 803-1 can be used to form a corner in a tiled transition bracket system. In such embodiments, the bracket connector 803-1 forms an inside corner. That is, the bracket connector 803-1 is an inside corner component for use in a tiled transition bracket system.

As discussed above in connection with FIGS. 1A-1C, in some embodiments, transition brackets and/or corner components (e.g., corner components shown in FIGS. 8A-10), can be connectorless. In embodiments in which the brackets and/or corner components are connectorless, the end surfaces of adjacent brackets and/or an end surface of a bracket and adjacent corner component may be secured to each other via an adhesive such as glue. In some embodiments in which the brackets and/or corner components are connectorless, the end surfaces of adjacent brackets and/or corner components may abut each other but may not be bonded together.

Although the bracket connector 803-1 in the embodiment of FIG. 8A is used to connect transition brackets at ninety degrees with respect to each other, embodiments are not so limited. For example, in various embodiments, the bracket connector 803-1 can be configured to form an inside corner at an angle greater than or less than ninety degrees.

In various embodiments of the present disclosure, a bracket connector can include one or more tile receiving slots. In the embodiment illustrated in FIG. 8A, the bracket connector 803-1 includes a first tile receiving slot 820-1 and a second tile receiving slot 820-2 formed therein. As shown in FIG. 8A, the first and second receiving slots can be separated by a divider 854 in some embodiments. A first tile strip (e.g., tile strip 130 shown in FIG. 1C) can be secured in the first slot 820-1 and a second tile strip can be secured in the second slot 820-2. In the embodiment of FIG. 8A, a miter joint can be formed between the first and second tile strips at divider 854. In various embodiments, the tile strips can extend to the edges of the bracket connector or can extend beyond the edges of the bracket connector (e.g., onto an adjacent bracket).

In various embodiments, a bracket connector can include a number of base portions securable to different surfaces. For instance, the bracket connector 803-1 includes a first base portion 810-1 securable to a first surface (e.g., WALL1 as shown), a second base portion 810-2 securable to a second surface (e.g., WALL2 as shown), and a third base portion 812 securable to a third surface (e.g., FLOOR as shown). In various embodiments, the first, second, and third surfaces can form a three-way inside corner.

In the embodiment shown in FIG. 8A, the third base portion 812 includes a channel 825 formed therein. The channel 825 can be adjacent to the receiving slots 820-1 and 820-2. The channel 825 can be used, for example, to receive a filler material (e.g., grout or caulk) after one or more tile strips are secured within slots 820-1 and 820-2 and a surface covering (e.g., a field tile) is secured adjacent to the bracket connector on the third surface (e.g., FLOOR in this embodiment). The depth of channel 825 can add depth to the joint between the tile strips and a surface covering (e.g., a tile covering) abutting the bracket connector, which can facilitate bonding of the filler material therein.

As shown in the embodiment of FIG. 8A, the first receiving slot 820-1 is angled with respect to the first surface WALL1 and the third surface FLOOR and located between first and third base portions 810-1 and 812, while the second receiving slot 820-2 is angled with respect to the second surface WALL2 and the third surface FLOOR and located between second and third base portions 810-2 and 812. As previously discussed in connection with FIGS. 1A-1C, the angle of the tile receiving slots can be a variety of angles suitable for providing a tiled transition at an inside corner between two surfaces. Providing an angled tiled transition can provide benefits including sanitation benefits and/or esthetic benefits, among other benefits.

In various embodiments, as discussed above, the first, second, and third surfaces can form a three-way outside corner. A three-way corner refers to an intersection of three surfaces (e.g., an intersection of two walls and a floor, an intersection of two walls and a ceiling, an intersection of two back splash surfaces and a countertop surface, etc.). In embodiments in which the first, second, and third surfaces form a three-way inside corner, the first, second, and third base portions of the bracket connector 803-1 can be secured in the corner via thin-set mortar, glue, nails, staples, and/or other securing mechanisms.

As mentioned above, in various embodiments, using a bracket connector can provide various benefits. For instance, bracket connector 803-1 can be used to provide proper alignment of portions of the bracket connector and portions of a transition bracket to which the bracket connector is connected. As an example, mating of a connector portion at an end of a transition bracket with connector portion 850-1 of bracket connector 803-1 can provide proper alignment of receiving slot 820-1 and the receiving slot of the transition bracket.

The use of a bracket connector such as 803-1 can also decrease the time and/or effort involved in installing a tiled transition. For instance, an installer can use a bracket connector, such as 803-1, at an inside corner of an installation area without manually cutting one or more transition brackets, in order to form a mitered corner, for example.

Figure 8B:
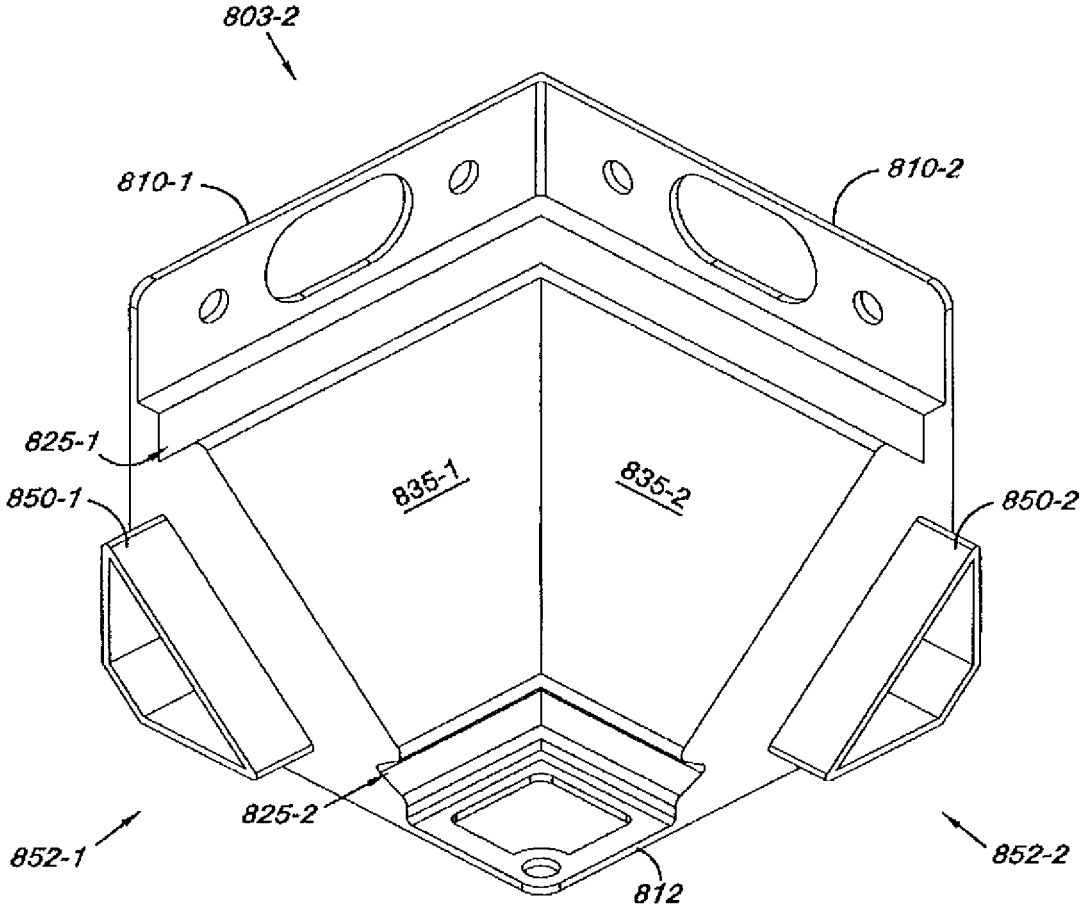
FIG. 8B illustrates another bracket connector according to an embodiment of the present disclosure.

FIG. 8B illustrates another bracket connector 803-2 according to an embodiment of the present disclosure. In the embodiment illustrated in FIG. 8B, the tiled transition bracket connector 803-2 includes a first end 852-1 having a first connector portion 850-1 sized to connect with an end of a first transition bracket and a second end 852-2 having a second connector portion 850-2 sized to connect with an end of a second transition bracket.

In the embodiment shown in FIG. 8B, the first and second connector portions 850-1 and 850-2 are male connector portions that can be received by a female connector portion of an end of a first and second transition bracket, respectively. However, as noted above, embodiments are not limited to bracket connectors having male connector portions or to transition brackets having female connector portions.

In the embodiment shown in FIG. 8B, the first end 852-1 and second end 852-2 of the connector 803-2 are perpendicular to each other such that connector portions 850-1 and 850-2 are perpendicular to each other. Such embodiments can, for example, be used to form a corner in a tiled transition bracket system. In such embodiments, the bracket connector 803-2 can be used to form an inside corner for use in a tiled transition bracket system.

Although the bracket connector 803-2 in the embodiment of FIG. 8B is used to connect transition brackets at ninety degrees with respect to each other, embodiments are not so limited. For example, in various embodiments, the bracket connector 803-2 can be configured to form an inside corner at an angle greater than or less than ninety degrees.

Unlike the inside corner component 803-1 shown in FIG. 8A, the inside corner component 803-2 of FIG. 8B does not include a tile receiving slot formed therein. Rather, as shown in FIG. 8B, the bracket connector 803-2 includes a first angled transition surface 835-1 opposite a first base portion 810-1 and a second angled transition surface 835-2 opposite a second base portion 810-2. That is, in the embodiment illustrated in FIG. 8B, the transition surfaces 835-1 and 835-2 do not have a tile strip secured thereto.

In various embodiments, the transition surfaces (e.g., 835-1 and 835-2) can have various shapes. For instance, the transition surfaces can be coved (e.g., rounded) surfaces or can have different decorative shapes and/or patterns.

In some embodiments, the first and/or second angled transitions can be angled so as to align with one or more tile strips secured within a transition bracket connected to the bracket connector 803-2. In various embodiments, the width of the transition portions can match a width of a tile receiving slot of a transition bracket connected to the bracket connector 803-2.

In the embodiment illustrated in FIG. 8B, the bracket connector 803-2 includes a number of base portions (e.g., surfaces of the bracket connector) securable to different surfaces (e.g., wall surfaces, floor surfaces, etc.). For instance, as described above in connection with FIG. 8A, the first base portion 810-1 can be secured to a first surface (e.g., WALL1 as shown in FIG. 8A), the second base portion 810-2 can be secured to a second surface (e.g., WALL2 as shown in FIG. 8A), and a third base portion 812 can be secured to a third surface (e.g., FLOOR as shown in FIG. 8A).

In the embodiment shown in FIG. 8B, the inside corner component 803-2 includes a first channel 825-1 adjacent to the angled transition surfaces 835-1 and 835-2. The corner component 803-2 also includes a second channel 825-2 adjacent to the angled transition surfaces 835-1 and 835-2. In the embodiment shown in FIG. 8B, the second channel runs parallel to the first channel and is at the opposite end of the angled transition surfaces as the first channel. The channels 825-1 and 825-2 formed in bracket connector 803-2 can receive a filler material (e.g., grout or caulking material) and can be positioned so as to align with joints associated with one or more transition brackets when the one or more transition brackets are connected to the bracket connector 803-2.

As an example, the channels 825-1 and 825-2 can be positioned such that they align with channels 525-1 and 525-2, respectively, of transition bracket 500 shown in FIG. 5 if transition bracket 500 is connected to the bracket connector 803-2 (e.g., via connector portions 545 and 850-1/850-2). Embodiments are not so limited. For instance, in some embodiments, one or both of the channels 825-1 and 825-2 may not align with a channel add/or joint associated with a transition bracket connected to the bracket connector 803-2.

As mentioned above, in various embodiments, using a bracket connector can provide various benefits. For instance, bracket connector 803-2 can be used to provide proper alignment of portions of the bracket connector and portions of a transition bracket to which the bracket connector is connected. The use of a bracket connector such as 803-2 can also decrease the time and/or effort involved in installing a tiled transition. For instance, an installer can use a bracket connector such as 803-2 at an inside corner of an installation area without manually cutting one or more transition brackets, in order to form a mitered corner, for example.

Another benefit associated with bracket connector 803-2 is that the first and second angled transition surfaces 835-1 and 835-2 provide an angled inside corner transition without the use of a tile strip (e.g., a tile strip is not secured to the transition surfaces). That is, the inside corner can be formed without securing a tile strip to the connector bracket 803-2 and without cutting one or more tile strips at an angle to produce a miter joint.

Figure 9A:
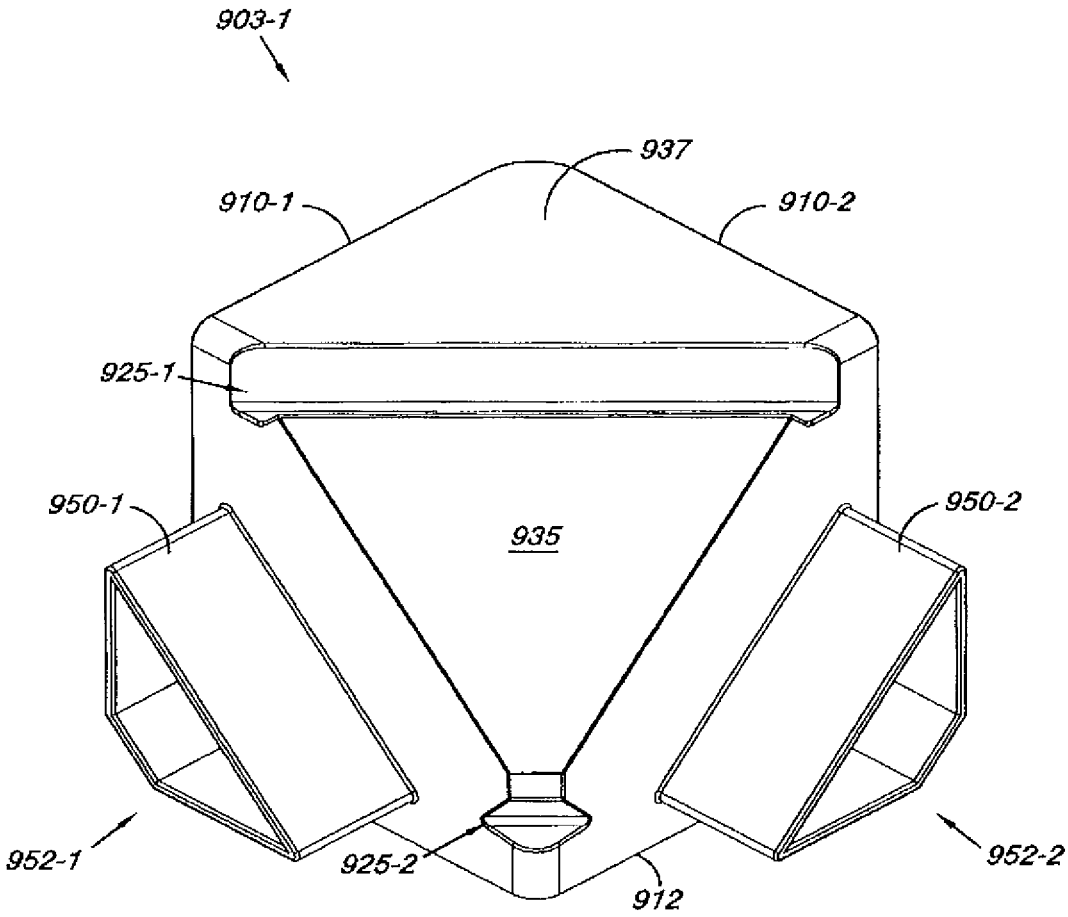
FIG. 9A illustrates another bracket connector according to an embodiment of the present disclosure.
Figure 9B:
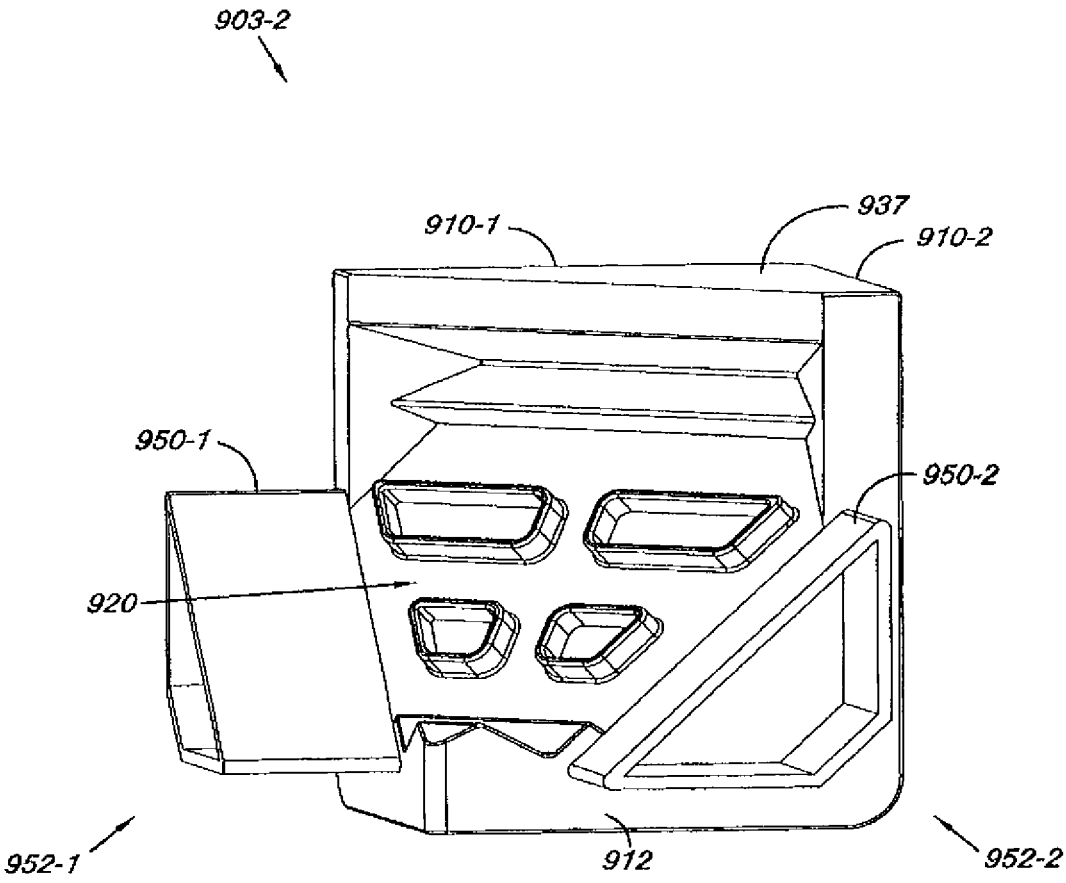
FIG. 9B illustrates another bracket connector according to an embodiment of the present disclosure.

FIG. 9A illustrates a bracket connector 903-1 according to an embodiment of the present disclosure. FIG. 9B illustrates another bracket connector 903-2 according to an embodiment of the present disclosure.

In the embodiments illustrated in FIGS. 9A and 9B, the tiled transition bracket connectors 903-1 and 903-2 include a first end 952-1 having a first connector portion 950-1 sized to connect with an end of a first transition bracket and a second end 952-2 having a second connector portion 950-2 sized to connect with an end of a second transition bracket.

In the embodiments shown in FIGS. 9A and 9B, the first and second connector portions 950-1 and 950-2 are male connector portions that can be received by a female connector portion of an end of a first and second transition bracket, respectively. However, as noted above, embodiments are not limited to bracket connectors having male connector portions or to transition brackets having female connector portions.

In the embodiment shown in FIGS. 9A and 9B, the first end 952-1 and second end 952-2 of the connectors 903-1 and 903-2 are perpendicular to each other such that connector portions 950-1 and 950-2 are perpendicular to each other. The bracket connectors 903-1 and 903-2 can be secured at a three-way inside corner in a tiled transition bracket system. That is, the bracket connectors 903-1 and 903-2 are inside corner components for use in a tiled transition bracket system.

Although the bracket connectors 903-1 and 903-2 in the embodiments of FIGS. 9A and 9B are used to connect transition brackets at ninety degrees with respect to each other, embodiments are not so limited. For example, in various embodiments, the bracket connectors 903-1 and 903-2 can be configured to form an inside corner at an angle greater than or less than ninety degrees.

In the embodiments illustrated in FIGS. 9A and 9B, the bracket connectors 903-1 and 903-2 include a number of base portions (e.g., surfaces of the bracket connectors) securable to different surfaces (e.g., wall surfaces, floor surfaces, etc.). For instance, as described above in connection with FIGS. 8A and 8B, the first base portion 910-1 can be secured to a first surface (e.g., WALL1 as shown in FIG. 8A), the second base portion 910-2 can be secured to a second surface (e.g., WALL2 as shown in FIG. 8A), and a third base portion 912 can be secured to a third surface (e.g., FLOOR as shown in FIG. 8A).

In various embodiments, a third transition bracket can be secured adjacent to the bracket connector (e.g., adjacent to surface 937 of bracket connector 903-1 and 903-2). Although not shown in the embodiments of FIGS. 9A and 9B, the surface 937 can include a third connector portion (e.g., a connector portion in addition to connectors 950-1 and 950-2) for connecting the bracket connector to the third transition bracket. In some embodiments, the third transition bracket can include a tile receiving slot and can be perpendicular to the first and second transition brackets.

As an example, consider bracket connector 903-1 or 903-2 to be secured at the inside corner of the intersection of two wall surfaces and a floor surface (e.g., base portion 910-1 secured to a first wall surface, base portion 910-2 secured to a second wall surface, and base portion 912 secured to a floor surface). In this example, a first transition bracket can be connected to connector 950-1 to form a first tiled transition between a first wall surface and the floor surface and a second transition bracket can be connected to connector 950-2 to form a second tiled transition between a second wall surface and the floor surface. The third transition bracket can be secured adjacent to bracket connector surface 937 to form a third tiled transition between the first and second wall surfaces. In this example, the first and second transition brackets would be perpendicular to each other and the third transition bracket along different axes, which would form a three-way tiled transition at the three-way inside corner.

In the embodiment illustrated in FIG. 9A, the inside corner component 903-1 includes an angled transition surface 935. The transition surface 935 can have various shapes and/or can be oriented at various angles. In various embodiments, the transition surface 935 is angled such that it aligns with the angle of a tile strip secured in the receiving slot of transition bracket connected to component 903-1.

In the embodiment shown in FIG. 9A, the inside corner component 903-1 includes a first channel 925-1 adjacent to the angled transition surface 935 and surface 937. The corner component 903-1 also includes a second channel 925-2 adjacent to the angled transition surface 935. In the embodiment shown in FIG. 9A, the second channel runs parallel to the first channel and is at the opposite end of the angled transition surfaces as the first channel. The channels 925-1 and 925-2 can receive a filler material (e.g., grout or caulking material)

and can be positioned so as to align with joints associated with one or more transition brackets when the one or more transition brackets are connected to the corner component 903-1.

As an example, the channels 925-1 and 925-2 can be positioned such that they align with channels 525-1 and 525-2, respectively, of transition bracket 500 shown in FIG. 5 if transition bracket 500 is connected to the bracket connector 903-1 (e.g., via connector portions 545 and 950-1/950-2). Embodiments are not so limited. For instance, in some embodiments, one or both of the channels 925-1 and 925-2 may not align with a channel and/or joint associated with a transition bracket connected to the corner component 903-1.

In the embodiment shown in FIG. 9B, the inside corner component 903-2 includes a tile receiving slot 920. A width of the slot 920 may be the same as the width of a tile receiving slot (e.g., 120 shown in FIG. 1A) formed in a transition bracket to be secured adjacent to the corner component 903-2. In the embodiment of FIG. 9B, the receiving slot 920 is angled with respect to three surfaces to which the corner component 903-2 is to be secured.

Figure 10:
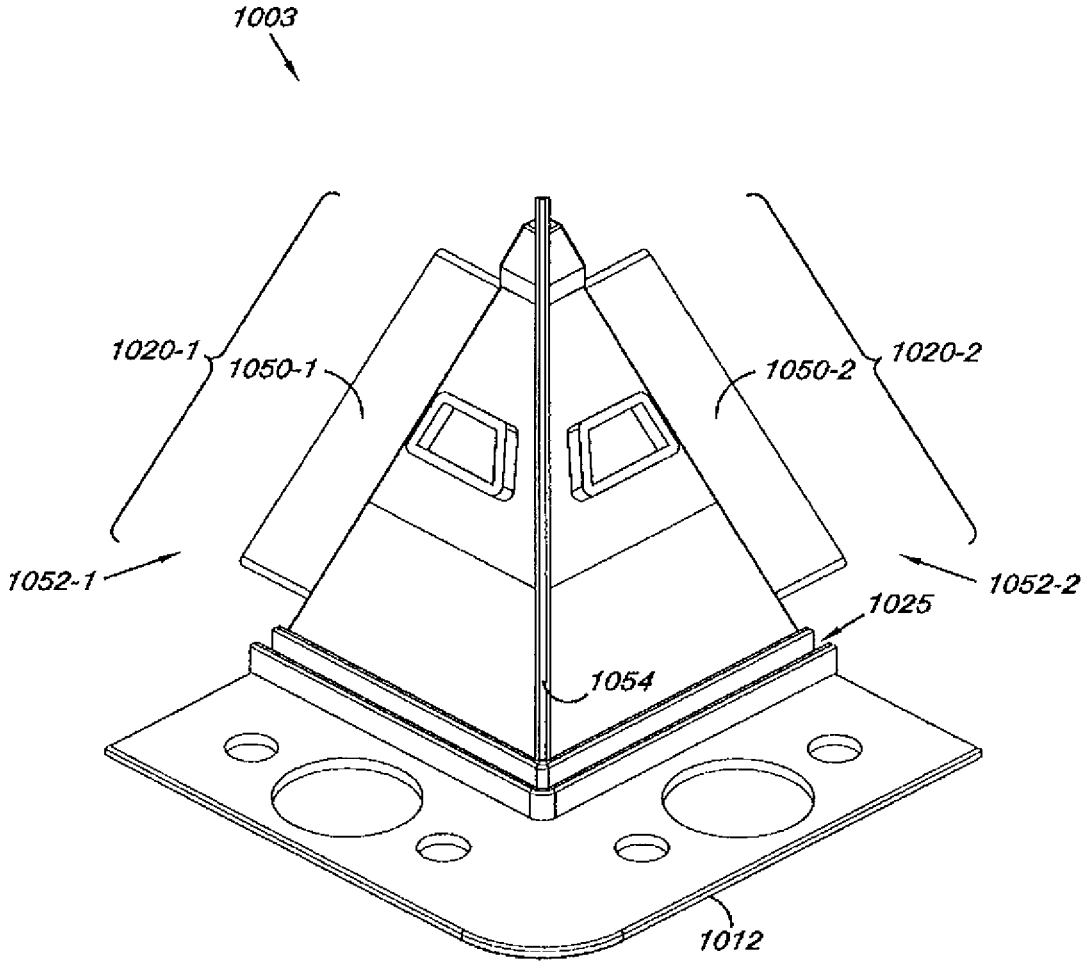
FIG. 10 illustrates another bracket connector according to an embodiment of the present disclosure.

FIG. 10 illustrates another bracket connector 1003 according to an embodiment of the present disclosure. In the embodiment illustrated in FIG. 10, the tiled transition bracket connector 1003 includes a first end 1052-1 having a first connector portion 1050-1 sized to connect with an end of a first transition bracket and a second end 1052-2 having a second connector portion 1050-2 sized to connect with an end of a second transition bracket.

In various embodiments, the first and second transition brackets that are connected by the bracket connector (e.g., connector 1003) include a tile receiving slot for forming a tiled transition between a first surface and a second surface. As described above, in various embodiments the first and the second surfaces form an inside corner (e.g., an inside corner between a wall surface and a floor surface or an inside corner between two wall surfaces).

In the embodiment shown in FIG. 10, the first and second connector portions 1050-1 and 1050-2 are male connector portions that can be received by a female connector portion of an end of a first and second transition bracket, respectively. However, as noted above, embodiments are not limited to bracket connectors having male connector portions or to transition brackets having female connector portions.

In the embodiment shown in FIG. 10, the first end 1052-1 and second end 1052-2 of the connector 1003 are perpendicular to each other such that connectors 1050-1 and 1050-2 are perpendicular to each other. The bracket connector 1003 can be used to form a corner in a tiled transition bracket system. In this embodiment, the bracket connector 1003 forms an outside corner. That is, the bracket connector 1003 is an outside corner component for use in a tiled transition bracket system.

Although the bracket connector 1003 in the embodiment of FIG. 10 is used to connect transition brackets at ninety degrees with respect to each other, embodiments are not so limited. For example, in various embodiments, the bracket connector 1003 can be configured to form an outside corner at an angle greater than or less than ninety degrees.

In the embodiment illustrated in FIG. 10, the bracket connector 1003 includes a first tile receiving slot 1020-1 and a second tile receiving slot 1020-2 formed therein. In some embodiments, an outside corner component can include more or fewer than two tile receiving slots. For example, in some embodiments the bracket connector 1003 may not have any tile receiving slots. In embodiments, in which an outside corner component (e.g., 1003) does not include a tile receiving slot, the component may include one or more angled transition surfaces (e.g., similar to angled transition surfaces 835-1 and 835-2 described in FIG. 8B).

As shown in the embodiment of FIG. 10, the first and second receiving slots can be separated by a divider 1054. In such embodiments, a first tile strip (e.g., the strip 130 shown in FIG. 1C) can be secured in the first slot 1020-1 and a second tile strip can be secured in the second slot 1020-2 to form a miter joint therebetween at divider 1054.

In various embodiments, an outside corner component (e.g., bracket connector 1003) can be secured to a number of different surfaces. For instance, the bracket connector 1003 can be secured at an intersection of three surfaces forming a three-way outside corner (e.g., at an outside corner of two wall surfaces and a floor surface, among others). As shown in FIG. 10, a base portion 1012 of the bracket connector 1003 can include a number of apertures that can facilitate mechanical bonding of the bracket connector to a surface (e.g., a floor surface or ceiling surface).

In the embodiment shown in FIG. 10, the bracket connector 1003 includes a channel 1025. The channel 1025 receives a filler material (e.g., grout, caulk, etc.) after one or more tile strips are secured within slots 1020-1 and 1020-2 and after a surface covering (e.g., a field tile) is secured adjacent to the bracket connector on a surface (e.g., a floor surface). The depth of channel 1025 can add depth to the joint between the tile strips and the field tile which can facilitate bonding of the filler material therein.

The use of an outside corner component in a tiled transition bracket system can provide various benefits. For instance, bracket connector 1003 can be used to provide proper alignment of portions of the bracket connector and portions of a transition bracket to which the bracket connector is connected. As an example, mating of a connector portion at an end of a transition bracket with connector portion 1050-1 of bracket connector 1003 can provide proper alignment of receiving slot 1020-1 and the receiving slot of the transition bracket.

The use of a bracket connector such as 1003 can also decrease the time and/or effort involved in installing a tiled transition. For instance, an installer can use a bracket connector such as 1003 at an outside corner (e.g., a three-way outside corner) of an installation area without manually cutting one or more transition brackets, in order to form a mitered outside corner, for example.

Various transition bracket embodiments and bracket connector embodiments of the present disclosure can be used in combination in a tiled transition bracket system. Further, various tiled transition system embodiments of the present disclosure can use a number of different types of transition brackets and/or a number of different types of bracket connectors.

Although specific embodiments have been illustrated and described herein, those of ordinary skill in the art will appreciate that an arrangement calculated to achieve the same results can be substituted for the specific embodiments shown. This disclosure is intended to cover adaptations or variations of various embodiments of the present disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for forming a tiled transition, comprising:

securing a first tile strip permanently in a first receiving slot of a bracket, the first receiving slot angled with respect to a first surface and a second surface that form an inside corner, wherein the bracket includes:

a first base portion securable to the first surface; and a second base portion securable to the second surface;

securing the bracket to the first surface and the second surface;

securing a first surface covering to the first surface; and securing a second surface covering to the second surface such that a tiled transition is formed between the first surface covering and the second surface covering;

wherein a grout joint is maintained between an edge of the first tile strip and at least one of:

an edge of the first surface covering; and an edge of the second surface covering; and wherein at least one of the first surface covering and the second surface covering overlap a portion of the bracket.

2. The method of claim 1, wherein the method includes securing the first tile strip permanently in the first receiving slot of the bracket prior to securing the bracket to the first and second surfaces.

3. The method of claim 1, wherein the method includes securing a second tile strip permanently in the first receiving slot of the bracket.

4. The method of claim 1, wherein the method includes securing a second tile strip permanently in a second receiving slot of the bracket.

5. The method of claim 1, wherein the method includes securing a third tile strip permanently in a third receiving slot of the bracket, and wherein the first, second, and third tile strips are angled with respect to each other.

6. The method of claim 1, wherein at least one of the first surface covering and the second surface covering is a ceramic tile.

7. The method of claim 6, wherein securing the first tile strip permanently in the first receiving slot of the bracket comprises securing a ceramic tile strip permanently in the first receiving slot.

8. The method of claim 6, wherein the method includes securing a portion of a first ceramic tile to a first leg of the bracket.

9. The method of claim 8, wherein the method includes securing a portion of a second ceramic tile to a second leg of the bracket.

10. The method of claim 1, wherein the method includes securing at least a second tile strip in at least one of:

the first receiving slot of the bracket; and a second receiving slot of the bracket.

11. A method for forming a tiled transition, comprising:

securely bonding a first base portion of a bracket to a first surface;

securely bonding a second base portion of the bracket to a second surface, the first and second surfaces forming an inside corner; and securing a tile strip in a receiving slot of the bracket to form a tiled transition between a surface covering secured to the first surface and a surface covering secured to the second surface;

wherein the tiled transition comprises a grout joint between the tile strip and an edge surface of the surface covering secured to the first surface and a grout joint between the tile strip and an edge surface of the surface covering secured to the second surface; and wherein at least one of the surface covering secured to the first surface and the surface covering secured to the second surface overlap a portion of the bracket.

12. The method of claim 11, wherein each of the first surface covering secured to the first surface, the surface covering secured to the second surface, and the tile strip comprise a ceramic material.

13. The method of claim 12, including filling the grout joint between the first surface covering and the tile strip with a grout material and filling the grout joint between the second surface covering and the tile strip with the grout material.

14. The method of claim 11, including securing the tile strip in the receiving slot prior to at least one of:

securing the surface covering to the first surface;

securing the surface covering to the second surface; and securely bonding the first base portion of the bracket to the first surface.

15. The method of claim 11, wherein the receiving slot is angled at about 45 degrees with respect to the first and the second surface.

16. A method for forming a tiled transition between ceramic tile secured to a first surface and ceramic tile secured to a second surface, the method comprising:

securely bonding a first base portion of a bracket to the first surface;

securely bonding a second base portion of the bracket to the second surface, the first and second surfaces forming an inside corner; and securing a ceramic tile strip in a receiving slot of the bracket angled with respect to the first and second surfaces in order to form the tiled transition between the ceramic tile secured to the first surface and the ceramic tile secured to the second surface;

wherein the ceramic tile secured to the first surface comprises:

a back surface bonded to the first surface;

a front surface opposite the back surface; and at least four edge surfaces;

wherein subsequent to securely bonding the first base portion of the bracket to the first surface and the second base portion to the second surface, the method includes filling a grout joint formed between the ceramic tile strip and an edge surface of the ceramic tile secured to the first surface; and wherein the ceramic tile secured to the first surface overlaps a portion of the bracket.

* * * * *